US009738108B2

(12) United States Patent
Ridless

(10) Patent No.: US 9,738,108 B2
(45) Date of Patent: Aug. 22, 2017

(54) IMAGE DISPLAY AND KIT

(71) Applicant: Circle Graphics, Inc., Longmont, CO (US)

(72) Inventor: Hank Ridless, San Francisco, CA (US)

(73) Assignee: Circle Graphics, Inc., Longmont, CO (US)

( * ) Notice: Subject to any disclaimer, the term of this patent is extended or adjusted under 35 U.S.C. 154(b) by 0 days.

(21) Appl. No.: 14/209,693

(22) Filed: Mar. 13, 2014

(65) Prior Publication Data

US 2014/0318722 A1 Oct. 30, 2014

Related U.S. Application Data

(60) Provisional application No. 61/785,686, filed on Mar. 14, 2013.

(51) Int. Cl.

| | |
|---|---|
| ***B42D 15/00*** | (2006.01) |
| ***B44C 5/02*** | (2006.01) |
| ***B44F 11/00*** | (2006.01) |
| ***A47G 1/06*** | (2006.01) |
| ***B41M 3/06*** | (2006.01) |

(Continued)

(52) U.S. Cl.

CPC ..... *B42D 15/0073* (2013.01); *A47G 1/0633* (2013.01); *B41M 3/06* (2013.01); *B41M 5/0047* (2013.01); *B41M 5/0064* (2013.01); *B44C 5/02* (2013.01); *B44F 11/00* (2013.01); *A47G 2001/0661* (2013.01); *B41M 1/24* (2013.01)

(58) Field of Classification Search

CPC ..... A47G 1/06; A47G 1/0633; A47G 1/10

See application file for complete search history.

(56) References Cited

U.S. PATENT DOCUMENTS 1,256,993 A * 2/1918 Eidlitz ..... A47G 1/10 40/782

1,596,091 A 8/1926 Fowler (Continued)

FOREIGN PATENT DOCUMENTS

DE 2524251 A1 12/1976

DE 9112606 U1 12/1991

(Continued)

OTHER PUBLICATIONS

Advisory Action dated Aug. 15, 2014 for U.S. Appl. No. 13/665,755, filed Oct. 31, 2012, pp. 1-3.

(Continued)

*Primary Examiner* — Gary C Hoge

(74) *Attorney, Agent, or Firm* — Intellectual Innovations Legal Advisors

(57) ABSTRACT

An image display comprising a substantially rigid support structure including a rectangular central sheet, four side strips and four back strips can be provided. An image can be provided on at least the front of the central sheet. The side strips can extend alongside respective edges of the central sheet and be adjoined to form four corners. The back strips can extend along respective side strips and be adjoined at respective corners for forming the assembled support structure. A mechanical securement device can be connected to adjoined back strips at each corner for rigidly securing the adjoined back strips together and for retaining the side and back strips in an assembled position.

10 Claims, 7 Drawing Sheets

(51) Int. Cl.
*B41M 5/00* (2006.01)
*B41M 1/24* (2006.01)

(56) References Cited

U.S. PATENT DOCUMENTS 1,986,674 A 1/1935 Gernandt
2,085,097 A 6/1937 Hansen
2,144,594 A 1/1939 Katz
RE22,683 E 10/1945 Piper
2,470,416 A 5/1949 Silver
2,660,825 A 12/1953 Howard
2,950,556 A 8/1960 Larios
3,024,553 A 3/1962 Rowley
3,214,855 A 11/1965 Winkler et al.
3,286,387 A 11/1966 Poertner
3,346,105 A 10/1967 Nye et al.
3,559,316 A 2/1971 Samuel
3,589,955 A 6/1971 Fletcher
3,657,796 A 4/1972 Gochnauer
3,757,445 A 9/1973 Stilwell
3,804,700 A 4/1974 Hoey
3,910,168 A 10/1975 Verreydt et al.
3,952,133 A 4/1976 Amos et al.
4,050,624 A 9/1977 Williams
4,112,604 A 9/1978 Ott et al.
4,167,241 A 9/1979 Zumbrunn
4,248,657 A 2/1981 Henry
4,279,087 A 7/1981 Crawford
4,528,053 A * 7/1985 Auer ..... B31B 1/64 156/204
4,738,041 A 4/1988 Drueck, Jr.
4,870,766 A 10/1989 Topping
4,947,922 A 8/1990 Stobart
5,182,063 A 1/1993 Lang et al.
5,255,458 A * 10/1993 Piel ..... A47G 1/0638 24/487
5,294,040 A 3/1994 Cohen et al.
5,359,794 A * 11/1994 Wood ..... G09F 1/12 40/789
5,513,455 A 5/1996 Walker
5,526,597 A 6/1996 Plotkin et al.
5,581,923 A 12/1996 Brandstetter
5,706,597 A 1/1998 Brandstetter
5,721,041 A 2/1998 Baratto
5,844,565 A 12/1998 Mizutani et al.
5,958,470 A 9/1999 Harding et al.
5,961,034 A 10/1999 Demunnik et al.
6,073,372 A 6/2000 Davis
6,119,386 A 9/2000 Henry et al.
6,163,995 A 12/2000 Lucchetti et al.
6,163,998 A * 12/2000 James ..... A47G 1/143 40/750
6,189,251 B1 2/2001 Wilson
6,253,471 B1 7/2001 Strauh
6,263,602 B1 7/2001 Seiber et al.
6,269,569 B1 8/2001 Doone
6,422,292 B1 7/2002 Berry et al.
6,510,637 B2 1/2003 Delozada et al.
6,684,546 B1 2/2004 Chang
6,689,517 B1 2/2004 Kaminsky et al.
6,920,712 B2 7/2005 Chaimberg
6,981,350 B1 1/2006 Redmon
6,983,524 B2 1/2006 Eastwood
7,191,555 B2 3/2007 Hughes
7,322,140 B2 1/2008 Peery
7,627,967 B1 12/2009 Torvik
7,823,309 B2 11/2010 Albenda
8,312,653 B2 11/2012 Fritsche
8,495,830 B2 * 7/2013 Price ..... A47G 1/06 40/611.01
2002/0014316 A1 2/2002 Sooklaris
2002/0129530 A1 * 9/2002 Delozada ..... A47G 1/141 40/788
2002/0144445 A1 10/2002 Gomez Del Campo Diaz Barrerio
2004/0010954 A1 1/2004 O'Brien et al.
2004/0016103 A1 1/2004 Eastwood
2004/0028935 A1 2/2004 Hauke
2004/0109958 A1 6/2004 Nigam et al.
2004/0127614 A1 7/2004 Jiang et al.
2004/0153204 A1 8/2004 Blanco
2005/0155903 A1 7/2005 Myers
2005/0274049 A1 12/2005 Schmidt
2006/0130385 A1 6/2006 Seo
2006/0155903 A1 7/2006 Soga et al.
2007/0006503 A1 * 1/2007 Klein ..... A47G 1/06 40/700
2007/0071950 A1 3/2007 Chaimberg
2007/0186456 A1 8/2007 Wagner
2007/0193099 A1 8/2007 Peters
2007/0256343 A1 * 11/2007 Yoon ..... A47G 1/0638 40/779
2008/0229641 A1 9/2008 Slautterback
2009/0229157 A1 * 9/2009 Mehler ..... A47G 1/0627 40/711
2009/0277580 A1 * 11/2009 Singer ..... B32B 37/203 156/325
2010/0199535 A1 8/2010 Reynolds
2011/0016759 A1 * 1/2011 Ramos-Gonzalez A47G 1/0633 40/773
2011/0056106 A1 3/2011 Bosma
2012/0267062 A1 * 10/2012 Ainge ..... B44D 3/18 160/371
2012/0297653 A1 * 11/2012 Ridless ..... A47G 1/141 40/773
2013/0205631 A1 * 8/2013 Steichen ..... A47G 1/0633 40/743
2013/0227868 A1 * 9/2013 Edmondson ..... A47G 1/0633 40/743
2014/0363592 A1 * 12/2014 Zhou ..... A47G 1/0633 428/32.22

FOREIGN PATENT DOCUMENTS

DE 202006003186 U1 2/2007
EP 0674301 A1 9/1995
EP 1610283 A2 12/2005
FR 2387771 A1 11/1978
GB 2441052 A 2/2008
GB 2447918 A 10/2008
GB 2457005 A 8/2009
GB 2461863 A 1/2010
JP H0718227 A 1/1995
JP H08147543 A 6/1996
JP 2005022381 A 1/2005
JP 4316949 B2 8/2009
WO WO-9112606 A1 8/1991
WO WO-0243965 A2 6/2002
WO WO-02091333 A2 11/2002
WO WO-02102186 A1 12/2002
WO WO-2007008065 A1 1/2007
WO WO-2008049176 A1 5/2008
WO WO-2009149532 A1 12/2009

OTHER PUBLICATIONS

Advisory Action dated Jun. 26, 2014 for U.S. Appl. No. 13/304,303, filed Nov. 23, 2011, pp. 1-3.
Amendment After Final Office Action dated Jun. 26, 2014 for U.S. Appl. No. 13/304,303, filed Nov. 23, 2011, pp. 1.
Non-Final Office Action dated Jul. 1, 2014 for U.S. Appl. No. 13/665,713, filed Oct. 31, 2012, pp. 1-16.
Response dated Sep. 2, 2014 for Final Office Action dated Mar. 20, 2014 and Advisory Action dated Aug. 15, 2014 for U.S. Appl. No. 13/665,755, filed Oct. 31, 2012, pp. 1-8.
Response dated Aug. 4, 2014 for Final Office Action dated Mar. 20, 2014 for U.S. Appl. No. 13/665,755, filed Oct. 31, 2012, pp. 1-3.
Response dated Sep. 15, 2014 for Final Office Action dated Mar. 25, 2014 and Advisory Action dated Jun. 26, 2014 for U.S. Appl. No. 13/304,303, filed Nov. 23, 2011, pp. 1-4.
Response dated Jul. 21, 2014 for Non-Final Office Action dated Jul. 1, 2014 for U.S. Appl. No. 13/665,713, filed Oct. 31, 2012, pp. 1-6.

(56) References Cited

OTHER PUBLICATIONS

Final Office Action dated Oct. 27, 2014 for U.S. Appl. No. 13/665,713, filed Oct. 31, 2012, pp. 1-7.
Non-Final Office Action dated Sep. 30, 2014 for U.S. Appl. No. 13/665,755, filed Oct. 31, 2012, pp. 1-14.
Notice of Allowance dated Nov. 4, 2014 for U.S. Appl. No. 13/304,303, filed Nov. 23, 2011, pp. 1-7.
Notice of Allowance dated Jan. 13, 2015 for U.S. Appl. No. 13/304,303, filed Nov. 23, 2011, pp. 1-4.
Notice of Allowance dated Dec. 16, 2014 for U.S. Appl. No. 13/304,303, filed Nov. 23, 2011, pp. 1-2.
Notice of Allowance dated Jan. 26, 2015 for U.S. Appl. No. 13/665,713, filed Oct. 31, 2012, pp. 1-7.
Response dated Jan. 12, 2015 for Final Office Action dated Oct. 27, 2014 for U.S. Appl. No. 13/665,713, filed Oct. 31, 2012, pp. 1-2.
Response dated Mar. 30, 2015 for Non-Final Office Action dated Sep. 30, 2014 for U.S. Appl. No. 13/665,755, filed Oct. 31, 2012; pp. 1-14.
Amendment After Final Office Action dated Jun. 5, 2014 for U.S. Appl. No. 13/304,303, filed Nov. 23, 2011, pp. 1-10.
Applicant Initiated Interview Summary dated Jun. 10, 2014 for U.S. Appl. No. 13/304,303, filed Nov. 23, 2011, pp. 1-3.
Final Office Action dated Mar. 20, 2014 for U.S. Appl. No. 13/665,755, filed Oct. 31, 2012, pp. 1-20.
Final Office Action dated Mar. 25, 2014 for U.S. Appl. No. 13/304,303, filed Nov. 23, 2011, pp. 1-12.
Hirotaka, English Machine Translation of Japanese Patent Application No. 2005022381 entitled Panel for Pictures, and its Manufacturing Method, pp. 23.
International Search Report for Application No. PCT/US2011/062145, dated Jun. 26, 2012, pp. 1-7.
Non-Final Office Action dated Jul. 5, 2013 for U.S. Appl. No. 13/665,713, filed Oct. 31, 2012, pp. 1-11.
Non-Final Office Action dated Jun. 14, 2013 for U.S. Appl. No. 13/304,303, filed Nov. 23, 2011, pp. 1-14.
Non-Final Office Action dated Jun. 27, 2013 for U.S. Appl. No. 13/665,755, filed Oct. 31, 2012, pp. 1-8.
Notice of Allowance dated Dec. 6, 2013 for U.S. Appl. No. 13/665,713, filed Oct. 31, 2012, pp. 1-10.
Response dated Dec. 13, 2013 for Non-Final Office Action dated Jun. 14, 2013 for U.S. Appl. No. 13/304,303, filed Nov. 23, 2011, pp. 1-12.
Response dated Dec. 13, 2013 for Non-Final Office Action dated Jun. 27, 2013 for U.S. Appl. No. 13/665,755, filed Oct. 31, 2012, pp. 1-5.
Response dated Nov. 13, 2013 for Non-Final Office Action dated Jul. 5, 2013 for U.S. Appl. No. 13/665,713, filed Oct. 31, 2012, pp. 1-6.
Non-Final Office Action dated Feb. 19, 2016 for U.S. Appl. No. 14/729,764, filed Jun. 3, 2015, pp. 1-10.
Notice of Allowance dated Jul. 8, 2015 for U.S. Appl. No. 13/665,755, filed Oct. 31, 2012, pp. 1-7.

* cited by examiner

IMAGE DISPLAY AND KIT

CROSS REFERENCE TO RELATED APPLICATION

This application claims priority to U.S. provisional patent application Ser. No. 61/785,686 filed Mar. 14, 2013, the entire content of which is incorporated herein by this reference.

SCOPE OF THE INVENTION

The present invention relates to an image display, and more particularly to a display resembling a wooden stretcher frame.

BACKGROUND

Wooden stretcher frames for mounting painted or printed images have heretofore been provided. Image substrates for use with such frames include artist's canvas. The image substrate is typically stretched over the wooden stretcher frame, secured to the backside of the frame with staples or other hardware, and externally folded at the corners of the frame. Other support structures not constructed from wood, but when having an image substrate mounted thereon have the appearance of a wooden stretcher bar frame, have been additionally provided. Unfortunately, such support structures are typically expensive or do not provide a mounted image that is professional in appearance. Additionally, such artist's canvases are expensive.

There is a need for new support structures and image substrates that address such disadvantages.

DETAILED DESCRIPTION OF THE INVENTION

The present disclosure relates to image displays. More particularly the disclosure relates to several embodiments of images mounted on support structures. The image may be a photograph, a graphic design, a painting, or other image intended to be displayed. The image may be drawn, printed, jetted, developed, or otherwise imparted on an image substrate or on a support structure. Suitable digital printing techniques include inkjet printing and laser printing. The digital printing may impart a pigment-carrying or dye-carrying medium on the surface on which the image is printed so as to create the image. Other printing methods or other processes for imparting an image on a surface may be used.

The images may be printed on any suitable image substrate and the image substrate may be mounted on a support structure giving the appearance similar to that of an image stretched over a stretcher bar frame. The image substrate can include a canvas, a woven textile, a nonwoven textile, a fabric, a knit material, paper, plastic or any combination of the foregoing or any other suitable material. In some embodiments, the images may be digitally printed and the image substrate may be adhered to a backing. The backing may include display hardware for positioning the image substantially upright for viewing. In some instances, the image may be imparted directly on a portion of the support structure, for example any of the support structures disclosed herein, causing the respective portion of the support structure to form the image substrate and thus a separate image substrate may not be provided.

Figure 1:
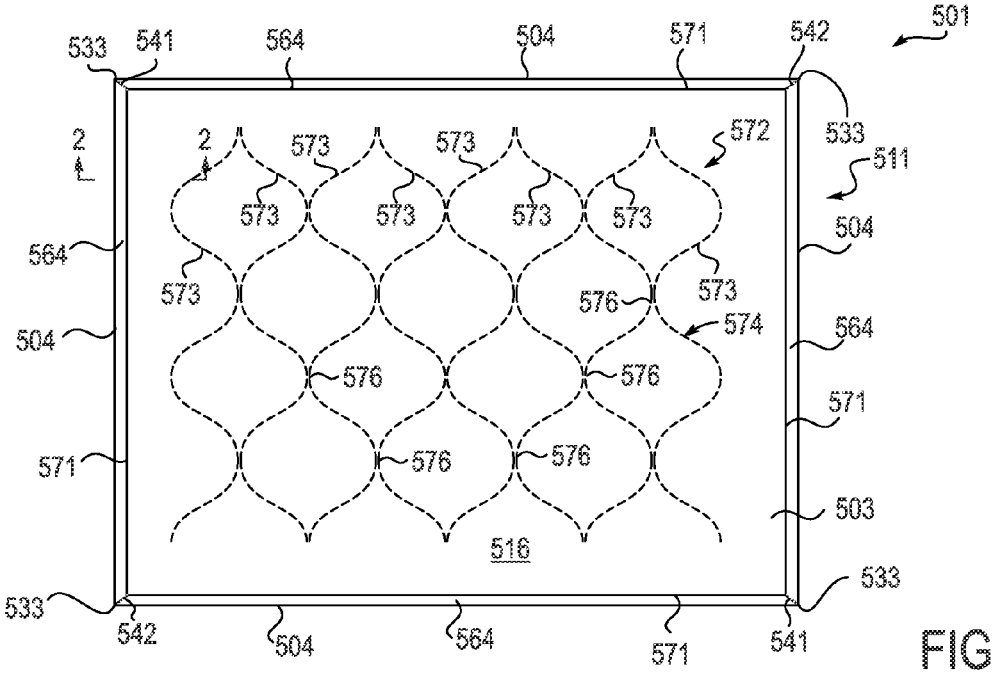
FIG. 1 is a rear plan view of an embodiment of an assembled image display of the present invention.
Figure 2:
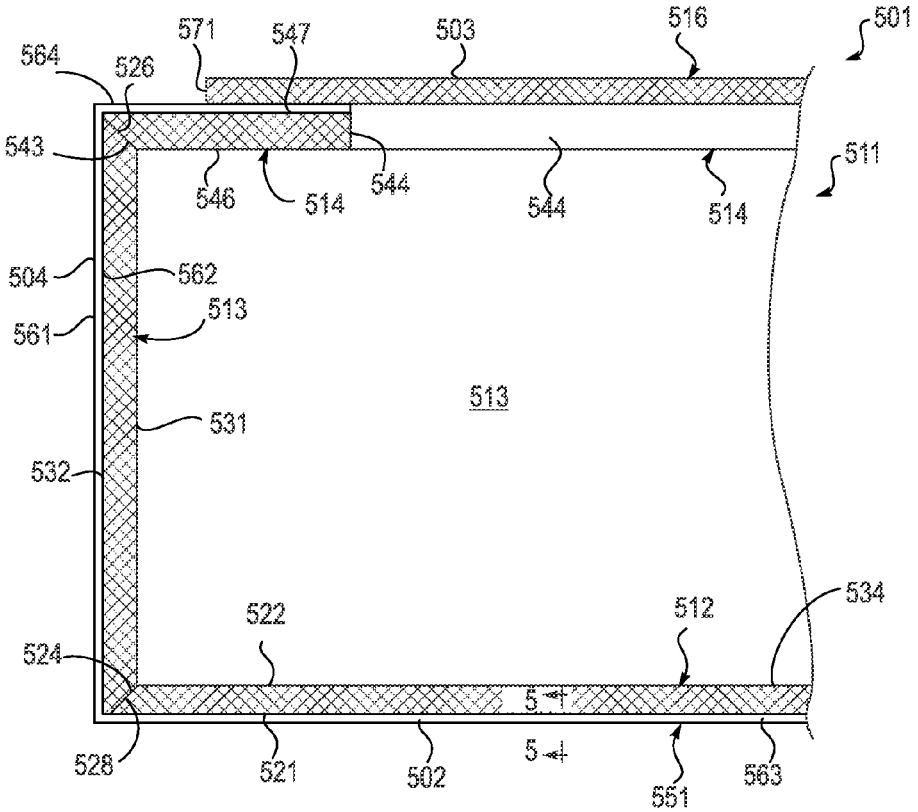
FIG. 2 is a cross-sectional view, taken along the line 2-2 of FIG. 1, of the assembled image display of FIG. 1.

One embodiment of an image display of the present invention is illustrated in FIGS. 1-6. Image display 501 therein has the appearance of a sheet of a suitable image substrate stretched over a wooden stretcher bar frame. Image display 501 can be of any suitable size and shape, and is generally planar in construction and has a thickness or depth ranging from 0.5 to 4.0 inches. In certain embodiments, the image display has a thickness or depth of approximately 0.5, 1.25, 2.0 or 4.0 inches. It is appreciated that the image displays of the present invention can be circular in plan, have a peripheral edge or other periphery that is arcuate, linear or a combination of arcuate and linear segments, or be spherical or other than a parallelepiped in shape. In one embodiment, the image display has the appearance of a polygon when viewed in plan, and thus has a plurality of linear or planar side surfaces and can be formed with a plurality of linear segments that are joined end-to-end to form a polygon. In one embodiment, image display 501 is rectangular in plan and, as illustrated in FIGS. 1-2, is provided with a first or front planar surface 502, an opposite second or rear planar surface 503 and four planar side surfaces 504 extending perpendicularly between the front and rear surfaces 502, 503. An image can be imparted on all or a portion of front surface 502, and can optionally be imparted on rear surface 503 and on side surfaces 504.

In place of a conventional wooden stretcher bar frame, images display 501 may include a support structure 511 formed from a front or central sheet 512, a plurality of peripheral or side strips 513 and a plurality of optional backs strips 514. An optional back sheet 516 can be included in the support structure, and the support structure 511 can be made from any suitable materials such as paperboard, a paper product, cardboard, fiberboard, wood, metal or plastic. One suitable fiberboard is medium density fiberboard or MDF or high density fiberboard or HDF. In one embodiment, the central sheet 512, side strips 513 and back strips 514 are each made from fiberboard and the back sheet 516 is made from either fiberboard or paperboard. Support structure 511 can be substantially rigid, and each of the elements of the substantially rigid support structure 511 can be of any suitable thickness, and where central sheet 512, side strips 513, back strips 514 and back sheet 516 are made from fiberboard in one embodiment have a thickness ranging from 0.020 to 0.250 inch, in one embodiment have a thickness ranging from 0.020 to 0.150 inch, and in one embodiment have a thickness of approximately 0.060 inch. In FIGS. 1-4, each of the central sheet 512, side strips 513, back strips 514 and the back sheet 516 can be made of fiberboard.

When image display 501 is substantially rectangular when in viewed in plan, central sheet 512 can be similarly rectangular in plan and have a length and width approximating the length and width of the image display 501. Although the planar central sheet can be perforated, for example be provided with a central rectangular or circular opening so as to reduce the material of the central sheet, in one embodiment the substantially rigid central sheet 512 is a solid, non-perforated and continuous sheet having a first or front surface or front 521, an opposite second or rear surface or rear 522 and a periphery 523 formed from a plurality of four edges 524. The external or front surface 521 can be substantially planar, and in one embodiment each of the elements of the support structure 511 are substantially planar. Each such edge 524 extends perpendicular to the two adjacent edges 524.

A plurality of four peripheral or side strips 513 extend alongside the periphery of the central sheet 512 and more specifically each side strip 513 extends along a respective edge 524 of the central sheet and is inclined rearwardly of the central sheet. In one embodiment, each of the planar side strips 513 is rectangular in plan and has a length approximating the length of the respective sheet edge 524 along which the strip 513 extends. The side strips 513 each have a width approximating the width of the image display 501. Each of the strips has opposite ends 526 and 527, and in one embodiment where the strips 513 extend perpendicularly of the central sheet 512, the strips 513 are joined, secured or coupled or engage or abut end-to-end such that end 526 of one strip 513 engages end 527 of the adjacent strip 513. Each of the strips 513 is provided with a first side edge 528 and an opposite second side edge 529, the first edge extending alongside the respective edge 524 of the central sheet 512. Strips 513 further include a first or inner surface 531 and an opposite second or outer surface 532. When the support structure 511 is assembled, the outer surfaces of the end-to-end side strips 513 form a peripheral side surface of the support structure.

In one embodiment, each edge 524 of the sheet 512 is beveled at a suitable angle such as 45° between front 521 and rear 522 of the sheet, and the first edge 528 of the each strip 513 is beveled at a suitable angle such as 45° relative to the inner surface 531 and outer surface 532 of the strip so that respective adjoining edges 524 and 528 seat flush with each other. Similarly, the first end 526 and the second end 527 of each strip 513 is angled or beveled at a suitable angle such as 45° relative to inner surface 531 and outer surface 532 of the strip such that the ends 526 and 527 of adjoining strips 513 seat flush with each other at the corner 533 formed by such adjoining strips 513. Rear surface 522 of central sheet 512 and inner surfaces 531 of the strips 513 form a cavity 534 behind central sheet of 512 of the support structure 511.

In one embodiment, the plurality of planar back strips 514 are equal in number to the plurality of side strips 513. Each of the back strips 514 has a first end 541 and an opposite second end 542, and a first edge 543 and an opposite second edge 544 extending between ends 541 and 542. A first or inner surface 546 and an opposite second or outer surface 547 extend between the ends and edges of each strip 514. The back strips 514 can each have a width, which is between edges 543 and 544, ranging from 0.250 to 1.00 inch and in one embodiment a width of approximately 0.50 inch. A back strip 514 extends alongside each side strip 513 and in one embodiment extends perpendicular to the side strip 513 and thus parallel to central to sheet 512. Second edge 529 of each side strip 513 can be beveled at a suitable angle such as 45° between surfaces 531 and 532 of the strip of 513, and first edge 543 of each back strip 514 can be beveled at a suitable angle such as 45° between surfaces 546 and 547 of the back strip 514, such that abutting edge 529 of the side strip and edge 543 of the back strip are flush with each other. Second edge 544 of each back strip can be of any suitable angle and in one embodiment is a butt edge, which is at 90° relative to inner and outer surfaces 546,547 of the back strip 514. The first end 541 and second end 542 of each back strip 514 can be mitered between edges 543 and 544 at a suitable angle such as 45° such that ends 541 and 542 of adjoining back strips 514 seat flush with each other when the back strips 514 are joined end-to-end at 90° relative to each other. The back strips 514 extend inwardly of respective side strips 513 and overlie at least a portion of periphery 523 of central sheet 512 and a portion of cavity 534.

Image display 501 includes an image substrate 551 that overlies at least central sheet 512 of the support structure 511. Image substrate 551 can be of any suitable type, and can be selected from several media used for imparting the image thereon. The image substrate 551 may be configured for receiving and holding the image imparted thereon and may be selected in conjunction with the ink, paint, or other pigment-carrying medium to suitably present the image. That is, consideration can be given to the crispness, or alternatively blurriness, desired in the image in the selection of the combination of media. The image substrate 551 may also be configured for forming to a shape. The image substrate 551 may be relatively thin and freely flexible and bendable such that it may be formed, folded, creased, or otherwise adapted to engage the support structure 511 without cracking, splitting, tearing, or showing undue stress. The image substrate 551 may have a thickness ranging from approximately 0.005 inch to approximately 0.0025 inch. In one embodiment, the image substrate 551 may have a thickness ranging from approximately 0.007 inch to approximately 0.015 inch. In one embodiment, the image substrate has a thickness ranging from approximately 0.005 inch to approximately 0.010 inch. In still other embodiments, the image substrate 551 may have a thickness of approximately 0.012 inch.

Figure 6:
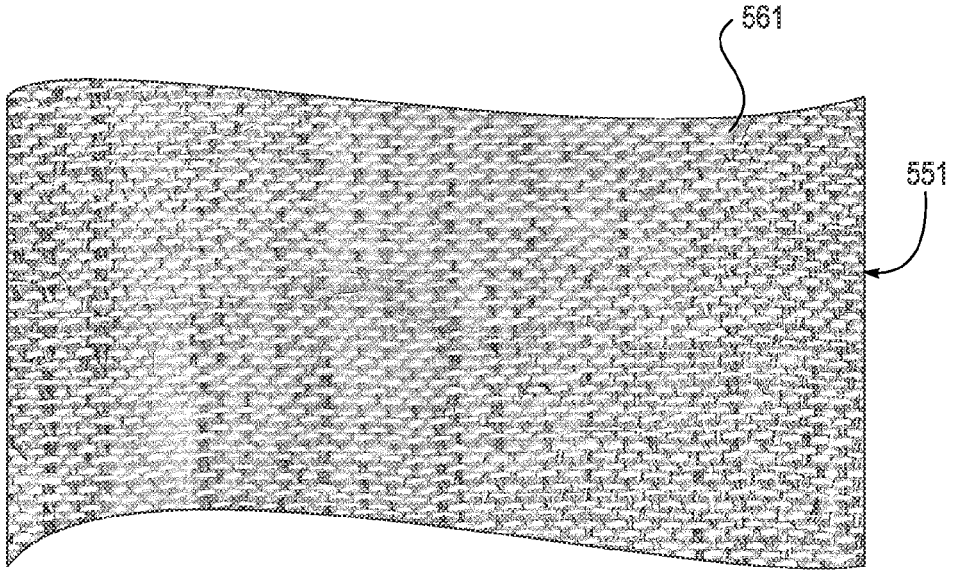
FIG. 6 is a plan view, taken along the line 6-6 of FIG. 5, of a portion of the image display of FIG. 1.

In one embodiment, the image substrate 551 may be formed from any suitable material and can, for example, be a membranous material in the form of a layer of thin plastic, film, textile, foil, or paper material. In one embodiment, image substrate 551 can be a textile-like material that resembles artist's canvas and in one embodiment the image substrate can be any suitable material that resembles artist's canvas, as illustrated in FIG. 6. In one embodiment, image substrate 551 includes a membranous layer 552 made from any suitable material such as a textile fabric, a nonwoven textile, a textile, a nonwoven fabric, a knitted material or a fabric and in one embodiment a suitable woven textile fabric. In one embodiment, the membranous layer 552 can be formed from a cotton woven textile, a polyester woven textile or other synthetic or natural fiber woven textile, a linen, or a combination or blend of some or all of the foregoing. In one embodiment, the layer 552 can be formed from a micro porous film, for example one which is polyolefin-based with 60% of its weight comprised of non-abrasive filler and 65% of its volume comprised of air. A suitable such film is the TESLIN™ substrate manufactured by PPG Industries of Monroeville, Pa. In one embodiment, the woven textile can be a coarse woven textile, such as canvas, an open weave textile, a fine or tightly woven textile, a loosely woven textile or a combination of the foregoing. The weight of the woven textile can range from 2-12 ounces per square yard, and can include woven textiles ranging from 2 to 5 ounces per square yard or from 3 to 4 ounces per square yard, sometimes referred to as light weight woven textiles, woven textiles ranging from 7 to 9 ounces per square yard, sometimes referred to mid-range woven textiles, and woven textiles ranging from 10 to 12 ounces per square yard, sometimes referred to as a heavy-weight woven textiles. In one embodiment, membranous layer 552 is formed from a fine, tightly-woven textile, which can be smooth so as to minimize any texture in the layer 552, and has a weight ranging from 2 to 5 ounces per square yard. In one embodiment the membranous or substrate layer 552 can be an open weave textile that is at least 25% open in area. In one embodiment the textile of the substrate layer 552 can be at least 50% open in area and in one embodiment the textile can be approximately 50% open in area. Membranous layer 552 can be formed from a nonwoven textile, which can be smooth so as to minimize any texture in the layer 552, and in one embodiment have a weight ranging from 0.2 to 0.7 ounces per square yard, in one embodiment have a weight ranging from 0.3 to 0.6 ounces per square yard and in one embodiment have a weight of approximately 0.5 ounces per square yard. Textile or base layer 552 can have a thickness ranging from 0.005 to 0.030 inch and in one embodiment has a thickness of approximately 0.015 inch. Textile or base layer 552 can be printable.

Image substrate 551 can further include at least one optional plastic layer overlying substrate layer 552. Such at least one plastic layer can include a plastic or polymer layer 553 overlying base or substrate layer 552. Suitable plastics include thermoplastics or thermo softening plastics, as well as thermosetting plastics. Layer 553 can be joined or adhered to base layer 552 by any suitable means and in one embodiment can be a preformed or other film that is laminated to the base layer 552. In one embodiment, the layer 553 can be applied over the base layer 552 as a liquid. In one embodiment, the layer 553 is extruded onto the base layer 552, for example in the form of a sheet or film and allowed to solidify affixed to the base layer. Suitable materials for plastic or polymer layer 533 include polyurethanes, polyesters, acrylics, vinyl polymers, polyolefins, polyamides, polyethers, epoxy based polymers, cellulosic polymers, polycarbonates and synthetic and natural rubbers, as well as mixtures, blends and copolymers utilizing some or all of the foregoing materials and other materials included to achieve the desired properties of the layer 553. The polymers may be thermoplastics, thermosets or cross-linked. Examples of thermoset materials include melamine, urea or benzoguanamine formaldehyde polymers, isocyanates and epoxy cross-linked materials. Examples of cross-linked materials include ultraviolet or electron beam cured acrylates, epoxys, vinyl ethers and polyols. The foregoing materials and compositions are not confined to any particular polymer architecture and the polymers can be linear, branched or dendritic. The plastic or polymer layer 553 can have a thickness ranging from 0.0005 to 0.020 inch and in one embodiment has a thickness of approximately 0.001 inch. The thickness and composition of the plastic or polymer layer 553 can be dependent upon factors that can include the composition and any texture of the substrate layer 552, the depth of any desired emboss of the image substrate 551, the amount of the material of the polymer layer 553 needed to provide a white or other desired color to the polymer layer 553, the desired opacity of the layer 553, any desired anti-fungal, anti-static and/or ultraviolet resistant properties of the layer 553, the desired rigidity of the layer 553, the finish of the layer 553, for example a matte or glossy finish, any desired moisture resistance or barrier coating properties of the layer 553 and any desired darkening effect of the layer 553 when exposed to light. The thickness and composition of the layer 553 can also be chosen to prevent deterioration when the image substrate 551 is exposed to the environment, for example ultraviolet light or humidity, to provide resistance to chemicals such as household cleaners and sprays and to serve as a flame retardant. Plastic or polymer layer 553 has a top or outer surface 554.

Image substrate 551 can optionally include one or more additional layers or coatings overlying the substrate layer 552. In certain embodiments, substrate layer 552 is printable without the need of a print-receptive coating and thus one or more such additional layers or coatings may not be needed for image substrate 551. In one embodiment, however, the at least one plastic layer includes a suitable print-receptive coating 556 that can overlie the top surface of substrate layer 552, or the top surface 554 of plastic or polymer layer 553. Print receptivity can include all or a combination of any of the following qualities: good adhesion to suitable inks such as water-based inks, solvent-based inks, ultraviolet or UV inks and oil-based inks, whether dye based or pigment based, and any suitable combination of the foregoing inks; good adhesion to toner based printing; a controlled and well defined immediate and long-term dot gain, for example from an ink jet printer; hold out, for example the retention of the ink on the top surface of the coating or layer and not penetrating into the coating or layer or otherwise losing color strength; and no dot skip, for example undulations may occur in the surface being printed that can cause ink jet drops to be hidden and give the appearance of poor print quality. Where receptivity is to dye-based inks, the dye can be anchored to inhibit or prevent migration or bleed. Suitable print-receptive coatings can include thermoplastics or thermo softening plastics, as well as thermosetting plastics, and can include polyurethanes, polyesters, acrylics, vinyl polymers, polyolefins, polyamides, polyethers, epoxy based polymers, cellulosic polymers, polycarbonates, synthetic and natural rubbers and other suitable polymers, as well as mixtures, blends and copolymers utilizing some or all of the foregoing materials and other materials included to achieve the desired properties of the coating. The polymers may be thermoplastics, thermosets or cross-linked. Examples of thermoset materials include melamine, urea or benzoguanamine formaldehyde polymers, isocyanates and epoxy cross-linked materials. Examples of cross-linked materials include ultraviolet or electron beam cured acrylates, epoxys, vinyl ethers and polyols. The foregoing materials and compositions are not confined to any particular polymer architecture and the polymers can be linear, branched or dendritic. Coatings 556 can be of any suitable thickness and can range in thickness from 0.001 to 0.020 inch and in one embodiment approximately 0.004 inch. The thickness and composition of the coating 556 can be dependent upon factors that can include the composition and any texture of the membranous layer 552, the composition and thickness of the plastic or polymer layer 553, the depth of any desired emboss of the image substrate 551, the amount of the material of the coating 556 needed to provide a white or other desired color to the coating 556, the desired opacity of the coating 556, any desired anti-fungal, anti-static and/or ultraviolet resistant properties of the coating 556, the desired rigidity of the layer 553, the finish of the layer 553, for example a matte or glossy finish, any desired moisture resistance or barrier coating properties of the layer 553 and any desired darkening effect of the layer 553 when exposed to light. The thickness and composition of the coating can also be chosen to prevent deterioration when the image substrate 551 is exposed to the environment, for example ultraviolet light or humidity, to provide resistance to chemicals such as household cleaners and sprays and to serve as a flame retardant. It is appreciated that the desired qualities of coating 556 can be depend on the composition and thickness of any underlying plastic or polymer layer 553, and thus the composition and thickness of one or both of layer 553 and coating 556 can be adjusted to effect the qualities of coating 556. In one embodiment, image substrate 551 can be free of a print-receptive coating overlying the plastic or polymer layer 533, for example where plastic or polymer layer 553 is print receptive. It is further appreciated that the image substrate 551 can be free of plastic or polymer layer 553. For example, the print receptive coating 556 can be joined or adhered directly to substrate layer 552.

In one embodiment, the image substrate 551 can be formed without the base layer 551 and instead consist only of the at least one plastic layer referenced above. In one embodiment the image substrate 551 can consist only of plastic or polymer layer 553, in one embodiment the image substrate 551 can consist of plastic or polymer layer 553 in combination with the print-receptive coating layer 556, in one embodiment can consist of the print-receptive coating layer 556 and in one embodiment can consist of some other combination of plastic or polymer layers.

Image substrate can be further optionally treated with a flame retardant to render it flameproof, to hinder damage due to ultraviolet light, moisture or humidity or any combination of the foregoing or any other protective coating (not shown) which can serve as the top or outer surface of the image substrate 551. Such a protective coating can overlie the penultimate outer layer of the image substrate 551, which as discussed above can be the substrate layer 552, the plastic or polymer layer 553 or the print-receptive coating 556 or can be any other layer of the image substrate 551.

Image substrate 551 has a top or outer surface 557, which for example can be the top surface of substrate layer 552 or the top surface 554 of plastic or polymer layer 553 where no print-receptive coating 556 is included in the image substrate or can be the top surface of the print-receptive coating where such a coating 556 is utilized in image substrate 551 and, for example, overlies the substrate layer 552 or the polymer layer 553 or is utilized without the substrate layer 552 and the polymer layer 553, or can be any protective coating provided as an outer layer of the image substrate 551. Under some circumstances the top surface 557 can reflect the weave or other texture of the base layer 552 and, as such, top surface 557 is textured or provided with a texture or design thereon. The amount of the texture or weave of base layer 552 that carries over or is reflected in top surface 555 is dependent upon a number of factors, including the coarseness of the weave, the amount of texture in base layer 552, the thickness and consistency of plastic or polymer layer 553 and the thickness of any print-receptive coating 556.

In another embodiment of image substrate 551, base or substrate layer 552 of the image substrate 551 can be formed from a non-woven textile or a fibrous material such as paper. The weight of such a non-woven textile or fibrous layer 552 can be chosen so as to provide image substrate 551 with the desired qualities of thickness and weight. In one embodiment where the substrate layer is formed from paper, the weight of paper layer 552 can range from 15 to 80 pounds per 3000 square feet and in one embodiment has a weight of approximately 30 pounds per 3000 square feet. In one embodiment where the substrate layer is formed from paper, the paper layer 552 can have a thickness ranging from 0.005 inch to 0.008 inch. As discussed above, a plastic or polymer layer 553 can optionally overlie the base layer 552, now formed from paper, and a print-receptive coating 556 can optionally overlie the top surface of the base layer 552 or the top surface 554 of the plastic or polymer layer 553. In one embodiment where substrate layer 552 is formed from a non-woven textile or a fibrous material such as paper, a print-receptive layer 552 is applied directly to such substrate layer 552 without an intervening plastic or polymer layer 553, and thus the image substrate 551 is free of a plastic or polymer layer 553.

An optional protective coating can be provided as an outer layer of such embodiment of image substrate 551. In this regard, a clear polymer coating may be applied atop any of the printed images of the display images of the present invention. Such a coating can provide a scratch resistant and washable surface over the printed image and protect against cracking and ultraviolet light.

Top or front surface 557 of the image substrate 551 can be optionally embossed or otherwise treated so as to provide a desired texture or other appearance to all or a portion of the top surface 557. In one embodiment, top surface 557 is embossed as to have the appearance of a woven textile such as canvas. The embossing or other treating of top surface 557 may be particularly desirable where base layer 552 has little texture. For example, where base layer 552 is a fine, tightly woven textile with a surface that is relatively smooth or an open-weave textile having a texture that does not resemble the desired texture of the image substrate 551, or the base layer 552 is formed from a non-woven textile or a fibrous material such as paper, top surface 557 can be embossed with the texture or appearance of a course, heavy or other woven textile, thus for example providing image substrate 551 with an appearance that resembles an artist canvas or other material with a coarse, heavy or other woven textile appearance. In a woven textile, the warp is the set of lengthwise yarns and the yarn that is inserted over-and-under the warp yarns is called the weft, woof or filler. Top surface 557 of the image substrate 551 can be embossed to have the appearance of woven warp and weft yarns, for example of a woven textile such as canvas. For example, top surface 557 can be embossed to have the appearance of cotton duck canvas coated with an acrylic, of coated cotton canvas or of coated canvas, where in each case the canvas can be of any weight, and thus have the appearance of an artist canvas. It is appreciated that all or any portion of top surface 554 can be embossed with any suitable pattern, design, texture, image or novel effect, for example the top surface 554 can be embossed with a fanciful image, drawing or picture that underlies the image to be printed on the substrate 551. Suitable textures include the texture of paint brush strokes, the texture of paint brush strokes on artist canvas, the texture of bamboo or cork, the texture of the outer surface of an orange.

In one embodiment, the polymer layer 553, the print-receptive coating 556 or both the layer 553 of polymer and the print-receptive coating 556 can be embossed, so for example to cause the image substrate to have a suitably textured first or top surface 557. In one embodiment where the substrate layer 552 is a layer or sheet of any suitable nonwoven material or a fibrous material such as paper, the overlying polymer layer 553 can be the print-receptive coating and the print receptive coating and the layer of membranous material can be embossed, so for example to cause the image substrate 551 to have a suitably textured first or top surface 557. The first surface 557 can have the appearance of a woven textile such as canvas, and in one embodiment the first surface 557, and some or all of the layers of image substrate 551 beneath the first surface 557, are embossed to have the appearance of a woven textile such as canvas. It is appreciated that any embodiment of an image substrate, including any of the embodiments of the image substrate disclosed herein, can be used on any of the support structures and image displays disclosed herein, and that any of the embodiments of the image substrate disclosed herein can be used on any suitable support structure or image display.

Top surface 557 of image substrate 551 can be embossed in any suitable manner. For example, the top surface 557 can be embossed with a roller. The depth of the embossing can vary, and depend for example on the depth of the texture or design to be created in the top surface 557. The embossing can extend into some or all of the layers of the image substrate. For example, the embossing can extend through both the plastic or polymer layer 553 and any print-receptive coating 556, only the polymer layer 553 or only the print-receptive coating 556. Where the layers being embossed are in a solid state, or otherwise not capable of retaining a deformity created therein without being heated or elevated in temperature, a heated roller can be utilized. Thus for example where both the polymer layer 553 and coating 556 are in a solid state, or in a state in which they cannot be deformed without the application of heat, whether after having been respectively applied for example as respective films and laminated to respective underlying layers or sequentially applied as coatings that have respectively solidified, a heated roller (not shown) can be utilized to emboss into or deform one or both of such layers and provide top surface 557 with a textured appearance. Where the one or more layers of the image substrate 551 to be embossed are in a liquid or other deformable state, the roller may not have to be heated. In one embodiment where substrate layer 552 is formed from a membranous or textile layer that is not deformable or otherwise not suitable for being embossed, and where image substrate 551 includes both polymer layer 553 and coating 556, both layer 553 and coating 556 are embossed or deformed to provide the top surface 557 of the image substrate with the desired texture, design or appearance. In one embodiment where substrate layer 552 is formed from a non-woven textile or fibrous material such as paper, and where image substrate 551 does not include polymer layer 553 but instead print-receptive coating 556 directly overlies the paper layer 552, coating 556 and paper layer 552 are embossed or deformed to provide the top surface 557 of the image substrate with the desired texture, design or appearance. In embodiments where the image substrate 551 consists only of plastic or polymer layer 553, only of print-receptive coating layer 556 or only both such layers, the foregoing layer or layers of the image substrate 551 are embossed or deformed to provide the top surface 557 of the image substrate with the desired texture, design or appearance. It is appreciated that at least certain papers and other materials suitable for layer 552 can be embossed or deformed, and thus one of polymer layer 553 or coating 556 may not be needed and thus not included in the layered structure of the image substrate 551.

In embodiments where the image substrate 551 includes the print-receptive coating 556 overlying an embossable image substrate layer 552 or an embossable plastic or polymer layer 553, the underlying layer embossable 552, embossable layer 553 or combination of such embossable layers can be embossed to the desired texture or appearance and the print-receptive layer 556 applied over such layer or layers after the embossing thereof. Such embossing can be accomplished by any of the methods discussed above, or in any other suitable manner.

One or more of the steps for forming image substrate 551 can be combined. In one embodiment of the invention the securing of the at least one plastic layer, which can be a molten layer, to the substrate layer 552 and the embossing of the image substrate 551 can occur in one step or simultaneously. For example, pellets of plastic can be melted and squeezed in an extrusion process for form the at least one plastic or polymer layer, which is in the form of a molten layer. The molten layer of plastic, formed in the foregoing manner or in any other suitable manner, can then go through a set of opposed rollers which squeeze the at least one plastic layer against the substrate layer 552 and simultaneously emboss the deformable at least one plastic layer. In one embodiment, the step of joining or securing step to the substrate layer and the embossing step and additionally include the simultaneous cooling of the molten plastic. For example, one or both of the opposed rollers can be chilled so as to cool the at least one plastic layer prior to printing thereon. Where no substrate layer 552 is included in the image substrate 551, the image substrate of the at least one plastic layer can be formed and embossed simultaneously in a similar manner, and optionally simultaneously chilled or cooled.

As discussed above, image substrate 551 has a first or front surface 557, formed by the outer surface of print-receptive coating 556 or where no such coating is provided formed by the outer surface of substrate layer 552 or the outer surface 554 of plastic or polymer layer 553. As discussed above, the first or front surface 557 can also be formed by a protective coating, including any of the protective coatings discussed above. Additionally, the image substrate 551 has an opposite second or rear surface 562, formed by the bottom surface of base or substrate layer 552 (see FIGS. 1-4). The image substrate further includes a central portion 563 and a peripheral portion 564. An image (not shown) is printed on front or outer surface 557, and more specifically on any texture or design provided, embossed or otherwise formed on front surface 557. The image can be printed or otherwise created on outer surface 557 either before or after any embossing of the image substrate 551 and any embossing of the outer surface 557. The image can be created from a single printing pass or multiple printing passes, some or all of which can occur before, after or before and after any embossing of the image substrate. For example, where the image substrate 551 is embossed to have a texture, for example a texture of cork or bamboo, the appearance or image of cork or bamboo can be created in a first printing pass and another desired image, for example an image of a person, created in a second printing pass. It is also appreciated that the appearance or image of an underlying texture, such as the appearance or image of cork or bamboo, can be created in a single printing pass with the other desired image. Thus, for example, a complex or aggregate image of a person overlying the appearance or image of cork or bamboo could be printed in a single printing pass on an image substrate embossed to have the respective texture of cork or bamboo.

It is appreciated that outer surface 557 need not be embossed or otherwise treated, and instead any suitable appearance can be created on the outer surface 557 in a single printing pass or in multiple printing passes. For example, the appearance or image of cork or bamboo can be created in a first printing pass and another desired image, for example an image of a person, created in a second printing pass. It is also appreciated that the appearance or image of an underlying texture, such as the appearance or image of cork or bamboo, along with the other desired image such as an image of a person, can be created in a single printing pass. Thus, for example, a complex or aggregate image of a person overlying the appearance or image of cork or bamboo could be printed in a single printing pass on an image substrate 551 that has not been embossed. Similarly, an image substrate 551 that has not been embossed can be printed to have the appearance of any of the woven textiles or textile-like materials discussed above beneath the other desired image, for example the image of a person.

The image substrate 551 extends across the front of support structure 511 and around the side surfaces of the support structure, which is outer surfaces 532 of side strips 513, and is secured to the support structure so as to have the appearance of being mounted a conventional stretcher bar frame. In this regard, the image covers at least a portion of the central portion 563, can cover all of the central portion 563 and can cover some or all of the peripheral portion 564 in addition to some or all of the central portion 563. Back surface 562 of central portion 563 of the image substrate overlies front 521 of central sheet 512 of the support structure and peripheral portion 564 of the image substrate 551 can optionally extend over outer surfaces 532 of the side strips 513 and can further optionally extend over outer surfaces 547 of the back strips 514. Hence the image substrate 551 can extend across some or all of the central portion 563, some or all of the peripheral portion 564, some or all of outer surfaces 532 of the side strips 513 and some or all of the outer surfaces 547 of the back strips 514. The image formed on outer surface 557 of the image substrate 551 can extend across all or any portion of such outer surface 557. In one embodiment, the back or rear surface 562 of the image substrate is secured directly to the central sheet, the side strips and the back strips in any suitable manner such as being adhered or glued thereto. Image substrate 551 is illustrated, for simplicity, as a single layer in FIGS. 1-4, and is shown as being secured directly to the support structure 512 therein. The image substrate 551 is taut relative to support structure 511 so that there are no wrinkles or other deformities in the image substrate 551 and the image substrate 551 thus has the appearance of being mounted on a conventional stretcher bar frame. Central sheet 512 provides a rigid backing for central portion 563 of the image substrate 551.

The peripheral portion 564 may define a generally rectangular, square, round, oval, or triangular shaped image substrate 551. Other shapes may also be provided. In the case of a round, oval, or oblong shaped image substrate, the peripheral portion 564 may be said to be continuous. In other cases, as shown in the figures, the peripheral portion 564 may be said to be discontinuous, for example, at the corners of the support structure 511.

Figure 3:
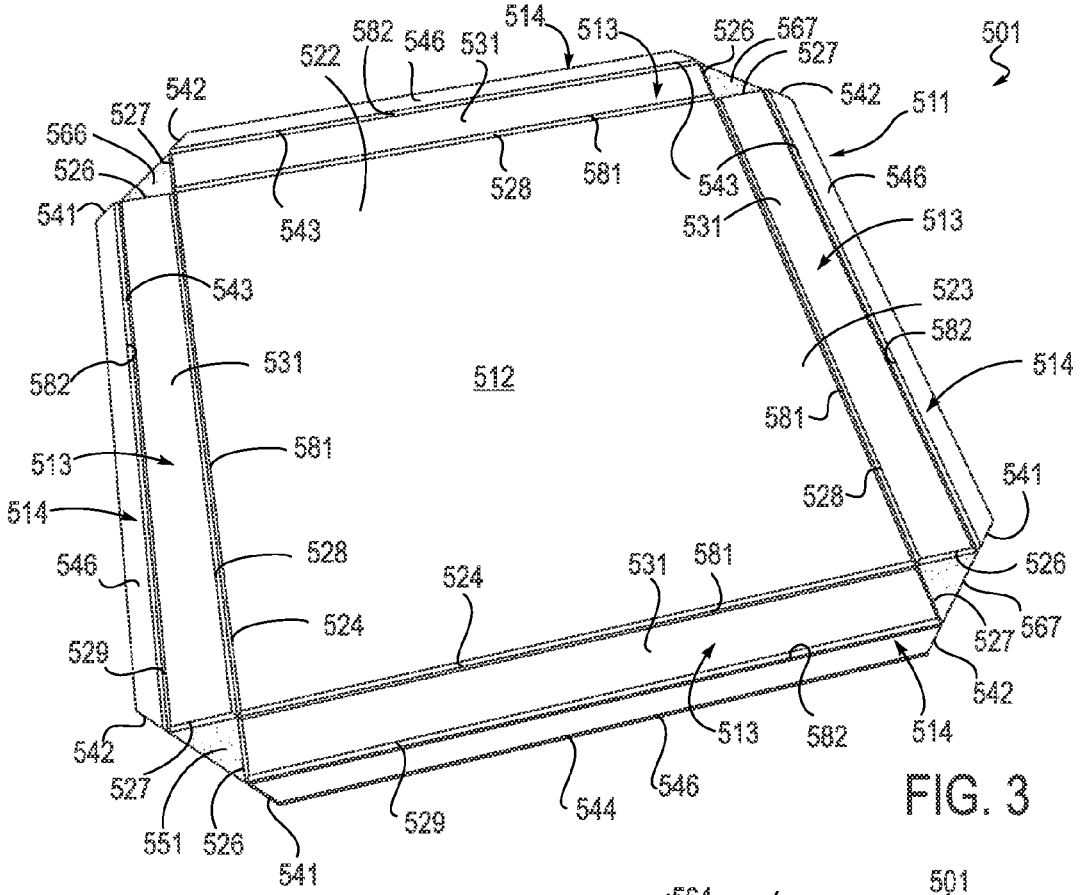
FIG. 3 is a rear view of a portion of a disassembled support structure of the image display of FIG. 1.
Figure 4:
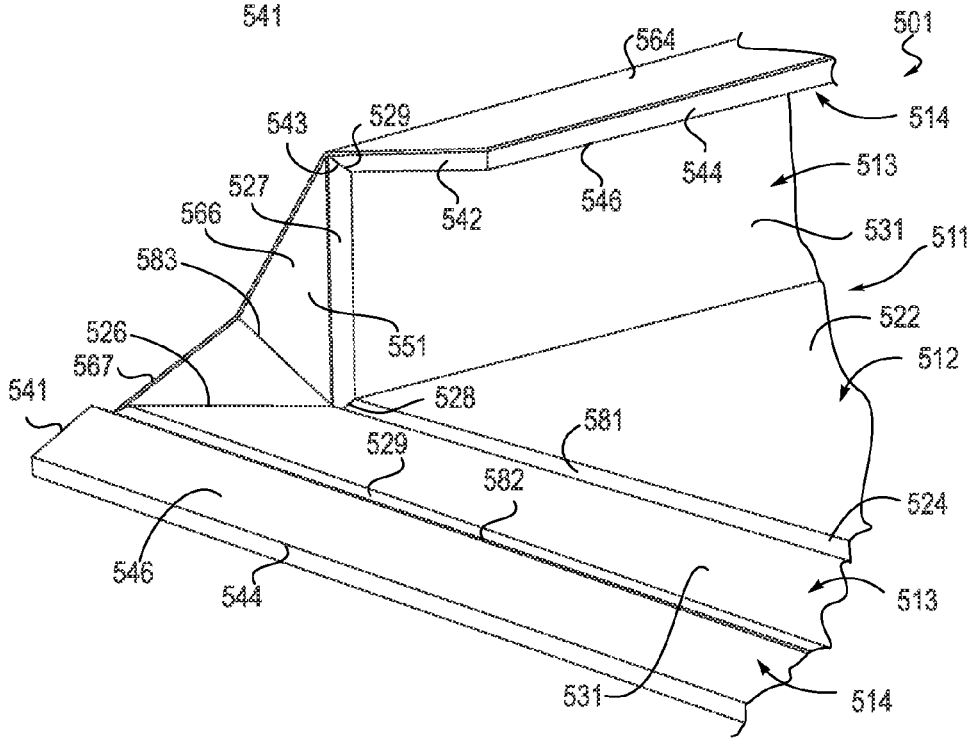
FIG. 4 is a side isometric view of the image display of FIG. 1 during the assembly thereof.
Figure 5:
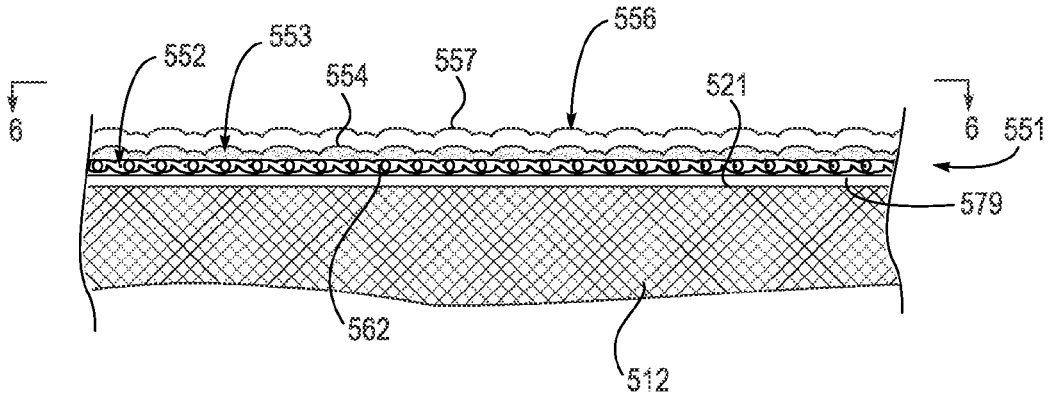
FIG. 5 is an enlarged cross-sectional view, taken along the line 5-5 of FIG. 4 and rotated 180°, of a portion of the image display of FIG. 1.

Image display 501 has a clean appearance at each of its corner 553, and in this regard is free of visible flaps or other gathered portions of the image substrate 551. The image substrate 551 is cut to a size which approximates the plan size and shape of the unfolded support structure 511. A flap 566, which can be triangular in shape, extends between the end folded ends 526 and 527 of each adjacent pair of side strips 513. Each flap 566 has an outer edge 567 that is collinear with angled edges 543 and 544 of the adjacent back strips 514. Flaps 566 and edge 567 are illustrated in FIGS. 3-4, wherein back surface 562 of the image substrate 551 is shown at flaps 566 and otherwise underlies central sheet 512, side sheets 513 and back strips 514 of the support structure 512.

Back sheet 516 overlies cavity 534 and is securely coupled to outer surfaces 547 of the back strips 514. The back sheet has a size and shape approximating the plan dimensions of image display 501, and in one embodiment back sheet 516 is rectangular in plan and is formed from a plurality of four linear edges 571 that form the rectangular shape of back sheet 516. The back sheet 516 can have a size and shape not larger than the size and shape of central sheet 512 of the support structure 511. In one preferred embodiment, the back sheet is dimensioned slightly smaller than the dimensions of the central sheet 512. Any suitable securement means is provided for rigidly coupling the back sheet 516 to the back strips 514, for example to outer surfaces 547 of the back strips 514. In one embodiment, such securement means includes any suitable adhesive such as glue, and the back sheet 516 is rigidly coupled to back strips 514 by being adhered to or glued to front surface 557 of a portion of the image substrate 551 overlying and adhered to outer surfaces 547 of the back strips 514.

The back sheet provides support structure 511 with a box-like structure, and thus forms a closed support structure 511. Back sheet 516 enhances the retention of side strips 513 and back strips 514 in their positions relative to central sheet 512. In this regard, the rigid coupling of the back sheet 516 to the back strips 514 counterbalances any forces imparted by the image substrate 551 on the support structure 511 that may otherwise urge back strips 514 to pivot away from each other and side strips 513 and the side strips 513 to pivot outwardly from the central sheet 512.

Back sheet 516 further provides image display 501 with a clean appearance from the rear that is free of any staples, fasteners or other retaining devices and hardware for securing the image substrate 551 to the back strips 514.

Edges 571 of the back sheet 516 are inset, that is spaced inwardly, from side surfaces 504 of the image display 501, and outer surfaces 532 of the side strip 513, a distance ranging from 0.100 to 0.375 inch and in one embodiment a distance of approximately 0.25 inch. Such insetting or recessing of back sheet edges 571 from the side surfaces 504 inhibit if not preclude viewing of the edges 571 when image display 501 is mounted on a support surface such as a wall. In addition, such exposed periphery on the rear of the support structure 511 provides an area to clamp or grip the back surface of the image display 501, and more specifically the back strip 514, when positioning and securing back sheet 516 to the support structure 511.

It is appreciated that other embodiments of a substantially rigid support structure can be provided. In one embodiment, such a support structure can include front sheet 512, back sheet 516 and a plurality of side strips 513 secured between the front sheet 512 and the back sheet 516 by any suitable means for forming a closed support structure with an internal cavity 534. In such embodiment, the side strips 513 can be secured to the back sheet 516 without the need of back strips 514, for example in a manner similar to the means in which sides strips 513 are secured to front sheet 512 as discussed above or otherwise. In one embodiment, where four side strips 513 are provided, the support structure would have a box-like structure, or have the shape of a parallepiped. The front sheet 512, side strips 513 and back sheet 516 can be made from any suitable material, for example fiberboard. In one embodiment, the substantially rigid support structure can be formed from a front sheet 512, four side strips 513 and a back sheet 516, each made from fiberboard and joined together in any suitable manner, so as to have the shape of a parallepiped.

An optional internal support 572 can be included in internal cavity 534 of the support structure 511 for enhancing the rigidity of the front sheet 512 of the support structure 511 (see FIG. 1). Although any suitable internal means or structure can be provided for enhancing the rigidity of the front sheet 512, in one embodiment the internal support 572 is a plurality of elements such as strips 573 extending between front sheet 512 and back sheet 516. The strips 573 can be made from any suitable material such as folded paper, paperboard, cardboard, fiberboard, plastic, foam, wood or metal. In one embodiment strips 573 are made from paperboard and secured to each of the sheets 512 and 516 by any suitable means such as an adhesive. Where a plurality of elements 573 are provided, the elements can extend substantially parallel to each other in spaced-apart position in the cavity 534 so as to extend between the sheets 512 and 516 at spaced positions within the cavity, for example substantially throughout the cavity. The elements 573 and can be joined together in any suitable manner so as to form a structure 574 for enhancing rigidity between the elements and thus the rigidity of the front sheet 512. In one embodiment, internal support 572 is formed from a plurality of elements or strips 573 wherein adjacent strips 573 are joined together in spaced-apart positions 576 by any suitable means such as an adhesive and then pulled apart to form a honeycombed internal support or honeycomb structure 572. The two opposite edges of the internal support, for example the opposite edges of each of elements or strips 573, are secured to the respective sheet 512 and 516 by an adhesive or any other suitable means. In one embodiment, the internal support is foam that fills all or a part of the internal cavity 534. Such foam can be flexible or rigid, and can be either added as a liquid and then expanded into foam or be in the form of preformed sheets, strips or other shapes. The foam can extend to the outer periphery of the internal cavity 534, so as to engage the inner surfaces 531 of side strips 513, or be spaced inwardly from some or all of the side strips. In one embodiment, the foam has a width and length when viewed in plan not larger than the rear opening of the support structure formed by back strips 514, and in one embodiment the foam has a width and length approximating the width and length of such rear opening. The foam can be secured by any suitable means such as an adhesive to one or both of central sheet 512 and back sheet 516, particularly for larger image displays, or neither.

An optional support layer 579 can be included in image display 501 for enhancing the rigidity of support structure 511, for example to hinder twisting or warping of the support structure 511 in all directions, to hinder a concave or convex appearance of the image substrate 551 provided on the front of the support structure 511 or both. Such support layer, which can be made from any suitable material such as paper, paperboard or plastic, can be disposed between image substrate 551 and support structure 511. For simplicity, such optional support layer 579 is shown only in FIG. 5. In one embodiment, support layer 579 is adhered to front 521 of the central sheet 512, outer surfaces 532 of the side strips 513 and outer surfaces 547 of the back strips 514 by any suitable means such as an adhesive or glue. The image substrate 551 can be similarly secured to the support layer 579. Similar to as discussed above with respect to the size and shape of image substrate 551, support layer 579 can have a size and shape approximating the plan size and shape of the unfolded central sheet 512, side strips 513 and back strips 514, as illustrated in FIG. 3. In one embodiment, the at least one layer or support layer 579 does not extend alongside flaps 566, but instead terminates at edges 543 and 544 of the back strips 514. Accordingly, in such embodiment, support layer 579 would not be visible in FIG. 3.

A method is provided for creating an image display such as image display 501. In a providing step of such method, a single sheet of material is provided for forming the support structure of the image display. The sheet of material, which can be a substantially rigid sheet, has opposite first and second surfaces and can be made from any suitable material such as any of the materials discussed above with respect to support structure 511. In one embodiment, the sheet is made from fiberboard and has a thickness corresponding to the thickness of central sheet 512, side strips 513 and back strips 514 of support structure 511 discussed above.

In a next adhering step of the method, at least one layer of material is adhered to the first surface of the sheet of material. Such at least one layer can include support layer 579, image substrate 551 or a combination of support layer 579 and image substrate 551. For example, in one embodiment the at least one layer can be the support layer 579. In another embodiment, the at least one layer can be image substrate 551, without support layer 579 or any other layer, such that image substrate 551 overlies and is adhered directly to support structure 511. In another embodiment, the at least one layer can include the support layer 579 and the image substrate 551 overlying the support layer. It is appreciated that other layers or combinations of layers can be provided for the at least one layer. When the at least one layer includes the image substrate, an image can be printed or formed on the image substrate prior to adhering the at least one layer to the sheet of material. The at least one layer is shown as image substrate 551 in FIGS. 2-4.

In a next shaping step of the method, the sheet of material is shaped so as to correspond to the shape of the unfolded support structure to be formed. In one embodiment of the method, the sheet of material in plan is shaped into the form or a central portion having a periphery and a plurality of peripheral strips extending around the periphery. For example, if the support structure were to consist of center sheet 512 and side strips 513, the sheet would have a shape corresponding in plan to central sheet 512 and side strips 513 extending around the periphery 523 of the central sheet 512 illustrated in FIG. 3. In such example of the method, the sheet of material would correspond to central sheet 512 and side strips 513, and the first surface of the sheet would correspond to front 521 of the central sheet and outer surfaces 532 of the side strips 513. The second surface of the sheet of material would correspond to rear 522 of the central sheet and inner surfaces 531 of the side strips 513. It is appreciated that shape formed in such shaping step can vary in accordance with the size and shape of the desired support structure. Thus, for example, if an image display having an octagonal shape and plan was desired, the sheet would be formed so as to have an octagonal central portion and a plurality of eight side strips extending around such central portion.

In a next forming step of the method, a plurality of grooves can be formed in the second surface of the sheet of material, that is the surface to which the at least one layer of material is not adhered, between the central portion and peripheral strips. For example, in the embodiment of a support structure consisting of a central sheet 512 and four side strips 513, four grooves 581 can be formed between the central sheet 512 and the four side strips 513, that is one groove 581 between the central sheet 512 and each side strip 513. The grooves 581 can be of any suitable shape. In FIG. 3, each groove 581 can have a V-shaped profile formed by the respective edge 524 of central sheet 512 and the opposing first edge 528 of the adjacent side strip 513, the opposing edges 524 and 528 extending at an angle at approximately 90° relative to each other. The at least one layer of material adhered or otherwise secured to the first surface of the sheet of material, enhances retention of the central portion and periphery strips, such as central sheet 512 and peripheral or side strips 513, together after formation of plurality of grooves 581. Although the grooves need not extend completely through the sheet of material, in one embodiment the grooves 531 extend through the sheet of material so that the central sheet 512 and side stripes 513 are held together in registration with each other substantially solely by the at least one layer of material.

If it is desired that the support structure include a plurality of back strips, such as optional back strips 514 of support structure 511, the shaping step can additionally include shaping the sheet of material such that the sheet of material in plan additionally includes a plurality of back strips extending around the central portion alongside the respective plurality of peripheral strips. In the embodiment illustrated in FIG. 3, the sheet of material would thus have a shape in plan resembling the shape of the central sheet 512, the four side strips 513 extending alongside or around periphery 523 of the central sheet and the four back strips 514 extending alongside or around the four side strips. When such back strips are included in the support structure, the forming step can additionally include forming an additional plurality of grooves 582 in the second surface of the sheet of material between the respective plurality of peripheral and side strips. In the embodiment illustrated in FIG. 3, such additional grooves can consist of four additional grooves 582 extending between the respective back strips 514 and side strips 513. The additional grooves 582 can be substantially similar in conformation in grooves 581 and may, as such, thus form respective second edges 529 of side strips 513 and opposing first edges 543 of back strips 514, each set of such edges 529 and 544 extending at an angle of approximately 90° relative to each other such that each additional groove 582 is V-shaped. In one embodiment, the additional grooves 582 each extend substantially though the entire sheet of material such that the back strips 514 and side strips 513 are held in registration relative to each other substantially solely by the at least one layer of material.

In a next folding step, the peripheral strips are folded relative to the central portion at the plurality of grooves so that the peripheral strips extend end-to-end around the periphery of the central portion. For example, in FIG. 3, peripheral or side strips 513 are folded, at grooves 581, toward rear 522 of central sheet 512 until first edges 528 of the side strips 513 engage flush with edges 524 of the central sheet and thus the respective ends 526 and 527 of adjacent side strips 513 engage and the side strips extend perpendicular to rear 522 of the central sheet. The beveled edges 524 of the central sheet 512 and the beveled first edges 528 of the side strips 513 inhibit over folding of the side strips relative to the central sheet.

When the support structure additionally includes a plurality of back strips, such as back strips 514, the folding step can additionally include folding such back strips relative to the peripheral strips at the additional plurality of grooves so that the back strips extend end-to-end over the periphery of the central portion. For example, in the embodiment of support structure 511 shown in FIG. 3, back strips 514 can be folded at additional grooves 582 towards inner surface 531 of the respective side strips 513 and towards rear 522 of the central sheet 512 until the back strips 514 extend substantially parallel to central sheet 512 and respective ends 541 and 542 of adjacent back strips 514 engage each other such that the back strips extend substantially in a plane extend parallel to the central sheet 512, as illustrated in FIGS. 1-2. The beveled second edges 529 of the back strips 513 and the beveled first edges 543 of the back strips 514 inhibit over folding of the back strips relative to the side strips.

As part of the folding step of the method, each flap 566 is folded inwardly, for example at a central or other crease 583 illustrated in FIG. 1, so that the inwardly folded flap extends between the abutting ends 526 and 527 of adjoining side strips 513 and between abutting ends 541 and 542 of adjoining optional back strips 514 when the support structure 511 and image display 510 are fully formed, as illustrated in FIGS. 1-2. Such inward folding of the corners of image substrate 551 into support structure 511 advantageously provides the image display with corners 533, side surfaces 504 and a rear surface 503 that is clean in appearance and free of visible folds in the image substrate 551. In this manner, the appearance of the image substrate is enhanced.

In an optional securing step of the method, the peripheral strips are secured together so that the central portion and peripheral strips forms a substantially rigid support structure. For example, in the embodiment of FIG. 3 where the support structure includes central sheet 512 and side strips 513, the side strips 513 and central sheet 512 can be secured together. In one embodiment, first edges 528 of the side strips 513 are glued to respective edges 524 of the central sheet 512, and ends 526 and 527 of adjacent side strips 513 are glued or otherwise adhered together.

When the embodiment of the support structure additionally includes back strips, such as back strip 514 of support structure 511, the back strips and peripheral side strips can be optionally secured together. In one embodiment, first edges 543 of the back strips can be glued or otherwise adhered to second edges 529 of the side strips 513, and ends 541 and 542 of adjacent back strips 514 can be glued or otherwise adhered together.

In optional additional steps of the method, a substantially rigid back sheet can be provided and the back sheet can be securely coupled to the back strips so as to provide a closed support structure formed from the central portion, the peripheral strips, the back strips and the back sheet. For example, in the embodiment of support structure 511 shown in FIGS. 1-4, back sheet 516 can be provided and placed over back strips 514 and secured to the back strips in the manner discussed above so as to provide a closed support structure 511, for example a support structure that resembles a box. As discussed above, peripheral edges 571 of the back sheet 516 are inset, that is spaced inwardly, from outer surfaces 532 of the side strips 513. In one embodiment, the securing of the back sheet 516 to the back strips 514, for example by an adhesive, is the sole means of securing the support structure 511 together. In this embodiment, no adhesive or other means would be used to secure the central sheet 512, side strips 513 and back strips 514 together.

Optional internal support 572 is placed within cavity 534 before closure of the cavity, for example by placement of sheet 516 on the rear of the support structure 511. The internal support 572 is formed, for example by a plurality of strips 573 in the manner discussed above, and can be secured at one end or edge to rear surface 522 of front or central sheet 512 and at its other end or edge to the rear surface of back sheet 516. Where the internal support 572 is formed from foam, the support 572 can be placed in cavity 534 after the back strips 514 have been folded parallel to the front sheet 512, or before.

Where the at least one layer of material in the adhering step is solely support layer 579, or any other combination of layers that does not include image substrate 551, an additional step can be provided in which image substrate 551 is adhered to the support layer 579 or such other combination of layers constituting the at least one layer. The image substrate 551 can be joined to the support layer or such other combination of layers either before or after the folding step. Further, an additional step of printing or otherwise forming an image on the at least one layer of material can be provided. In one embodiment the image is formed by any suitable digital printing technique such as ink jet printing. In one embodiment in which the at least one layer includes image substrate 551, the image can be printed or otherwise formed on front surface 557 of the image substrate 551, for example print-receptive coding 556 or top surface 554 of the polymer layer 553. The image can be so printed or otherwise formed on the image substrate 551 prior to the image substrate 551 being adhered to the sheet of material, for example central sheet 512, side strips 513 and optional back strips 514, or after the image substrate is adhered or otherwise secured to such sheet of material.

It is further appreciated that the steps of the foregoing method can be sequenced in any suitable order, for example, an order other than that described above.

In operation and use, image display 501 can be utilized with any of the foregoing support surfaces discussed above. The closed-box nature of support structure 511 provides for a substantially rigid image display 501 that is aesthetically pleasing in appearance and not flimsy in weight or appearance. Internal support 572 enhances the stiffness of front sheet 512 and inhibits any warping of the sheet 512 dues to moisture or other factors. Where front sheet 512 is formed from relatively lightweight fiberboard, for example fiberboard having a thickness of approximately 0.060 inch, such relatively thin fiberboard inhibits the front sheet 512 from hardening and thus retaining any warping that may occur in the sheet as a result of moisture or other factors. The relatively lightweight fiberboard in combination with the internal support 572 contribute to the front sheet 512 and the image substrate 551 thereon remaining substantially planar throughout the life of the image display 501.

Figure 7:
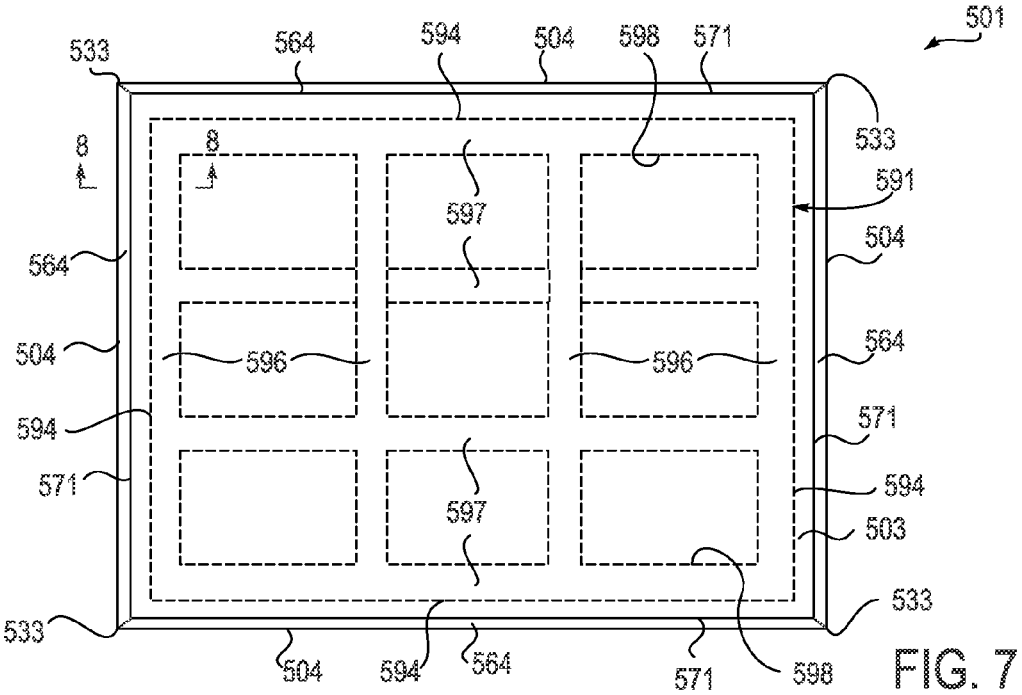
FIG. 7 is a rear plan view, similar to FIG. 3, of the assembled image display of FIG. 1 with another embodiment of the internal support.
Figure 8:
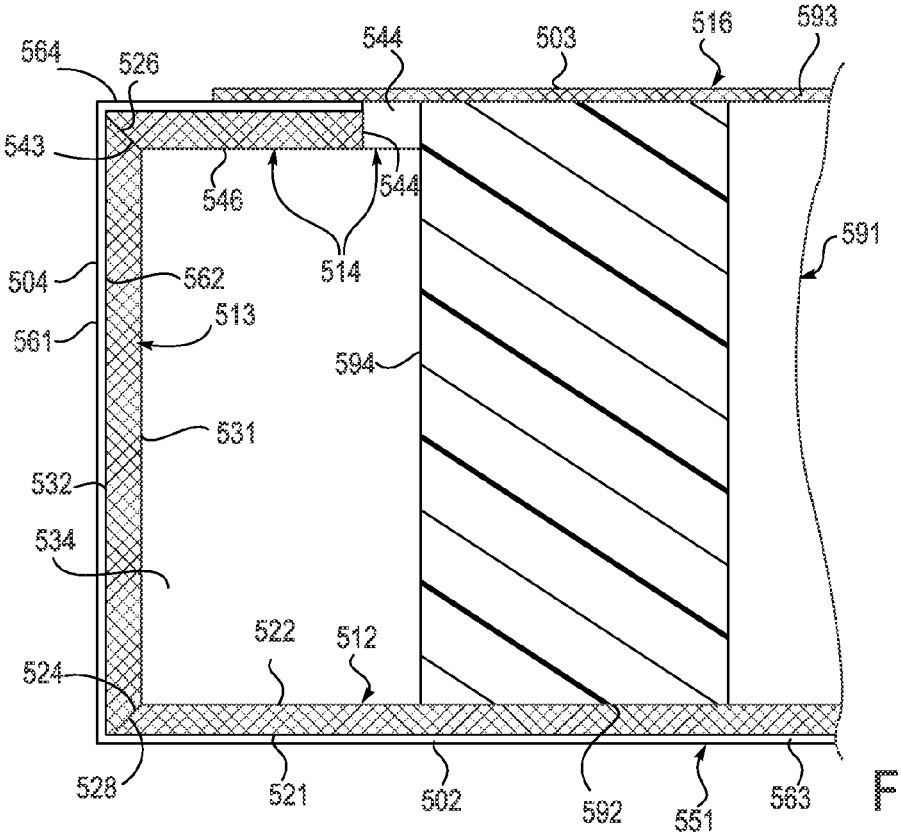
FIG. 8 is a cross-sectional view, taken along the line 8-8 of FIG. 7, of the assembled image display of FIG. 1.

Another embodiment of image display 501 is illustrated in FIGS. 7-8, and includes support structure 511 formed from central sheet 512, a plurality of peripheral or side strips 513, a plurality of optional backs strips 514 and the optional back sheet 516. In such embodiment of image display 501, the central sheet 512, side strips 513 and back strips 514 are each made from fiberboard, for example a high density fiberboard, so as to be substantially rigid. The back sheet 516 is made from paperboard, for example chipboard, or another paper product and is not substantially rigid. In one embodiment, the back sheet 516 is adhered to back strips 514 by any suitable means such as an adhesive, and in one embodiment such securing of the back sheet 516 to the back strips 514 is the sole means for securing together the central sheet 512, the side strips 513 and the back strips 514. In such embodiment, the central sheet, side strips and back strips are not otherwise secured together by an adhesive or other means.

An optional internal support 591 can be included in internal cavity 534 of the support structure 511 for enhancing the rigidity of the front sheet 512 of the support structure 511. Although any suitable internal means or structure can be provided for enhancing the rigidity of the front sheet 512, for example similar to internal support 572, in one embodiment the internal support 591 is a suitable foam that fills all or part of the internal cavity 534. The foam serving as the internal support of the present invention can be of any suitable type and in general can be the lowest cost foam that together with the support structure 511 provides a rigid structure for supporting the image substrate 551 and thus provides the image substrate 551 as having the appearance of being stretched across a conventional stretcher bar frame. In one embodiment, the foam of internal support 591 is a suitable expanded polystyrene. In one embodiment, the expanded polystyrene has a weight not above two pounds per cubic foot. In one embodiment, the expanded polystyrene has a weight not above 0.9 pounds per cubic foot. In one embodiment, the expanded polystyrene has a weight not above 0.5 pounds per cubic foot. In another embodiment, the foam of internal support 591 is a suitable polyurethane foam. In one embodiment, the polyurethane foam has a weight not above 0.4 pounds per cubic foot. In one embodiment, the foam is a two-part polyurethane foam.

In one embodiment, foam internal support 591 has a size and shape resembling the size and shape of internal cavity 534. In the illustrated embodiment, internal support 591 has substantially the shape of a parallelepiped with a first or top planar surface 592 that engages rear 522 of central sheet 512, a second or bottom planar surface 593 that engages the rear or backside of back sheet 516, and four side surfaces 594 that can be planar and extend perpendicularly between top surface 592 and bottom surface 593. The top surface 592 can be secured to the rear 522 of the central sheet, and the bottom surface 593 secured to the rear of back sheet 516, by any suitable means such as an adhesive or glue, however embodiments of the invention can be provided in which the internal support is not secured to one or both of rear 522 of the central sheet 512 and the rear of back sheet 516. In one embodiment, the side surfaces do not extend to the periphery of the internal cavity 534, and instead are each spaced inwardly from the inner surface 531 of the respective side strip 513. For example, each side surface 594 can be spaced inwardly from surface 531 a distance approximately equal to the width of the respective back strip 514. For example, foam support 591 has a length and width approximating the rear opening of the support structure formed by back strips 514, and can be placed in cavity 534 in any suitable manner including as discussed above.

The foam internal support 591 can be solid, for example having no recesses or openings therein, or be an open structure, for example a latticework, so as to reduce the amount of foam and thus the cost of the image display 501. As illustrated, internal support 591 is a latticework or grid structure formed from a plurality of first strips 596 and second strips 597 extending perpendicular to the first strips 596. The grid structure has a plurality of openings 598 or through holes extending between surfaces 593 and 594 which can, for example, be arranged in rows and columns.

The engagement and adherence of the internal support 591 with the central sheet 512 and the back sheet 516 provides rigidity to the support structure 511, and permits the back sheet 516 to be made from a less rigid material, and thus less costly material, such as paperboard. The rigidity of the central sheet 512 is transferred to the less rigid back sheet 516 by the substantially rigid, but lightweight, internal support 591. The engagement of the internal support 591 extends substantially across the entire backs of the central sheet 512 and back sheet 516 so as to provide rigidity to substantially the entire back sheet 516. The rigid connection between the central and back sheets provides a rigid construct that inhibits side strips 513 from moving relative to the central sheet 512, thus providing a substantially rigid support structure 511, for example resembling a conventional stretcher bar frame.

Figure 9:
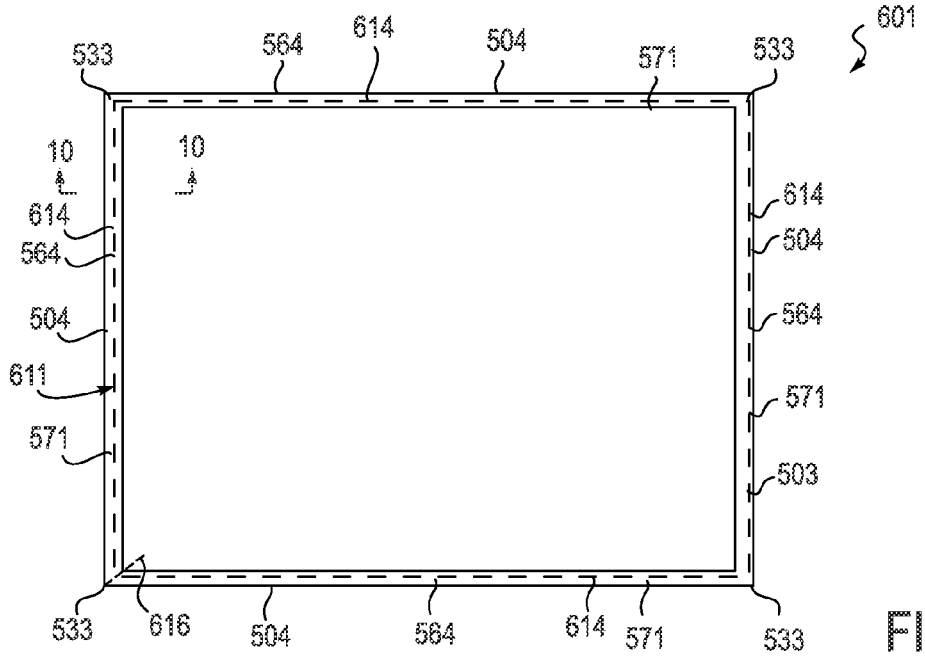
FIG. 9 is a rear plan view, similar to FIG. 7, of an assembled image display similar to the image display of FIG. 1.
Figure 10:
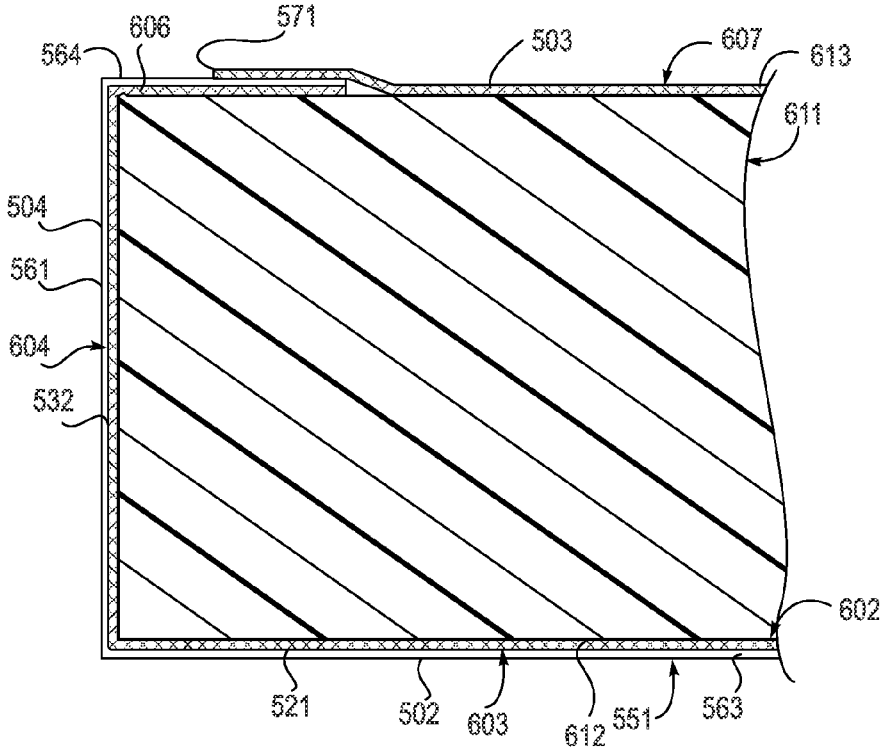
FIG. 10 is a cross-sectional view, taken along the line 10-10 of FIG. 9, of the image display of FIG. 9.
Figure 11:
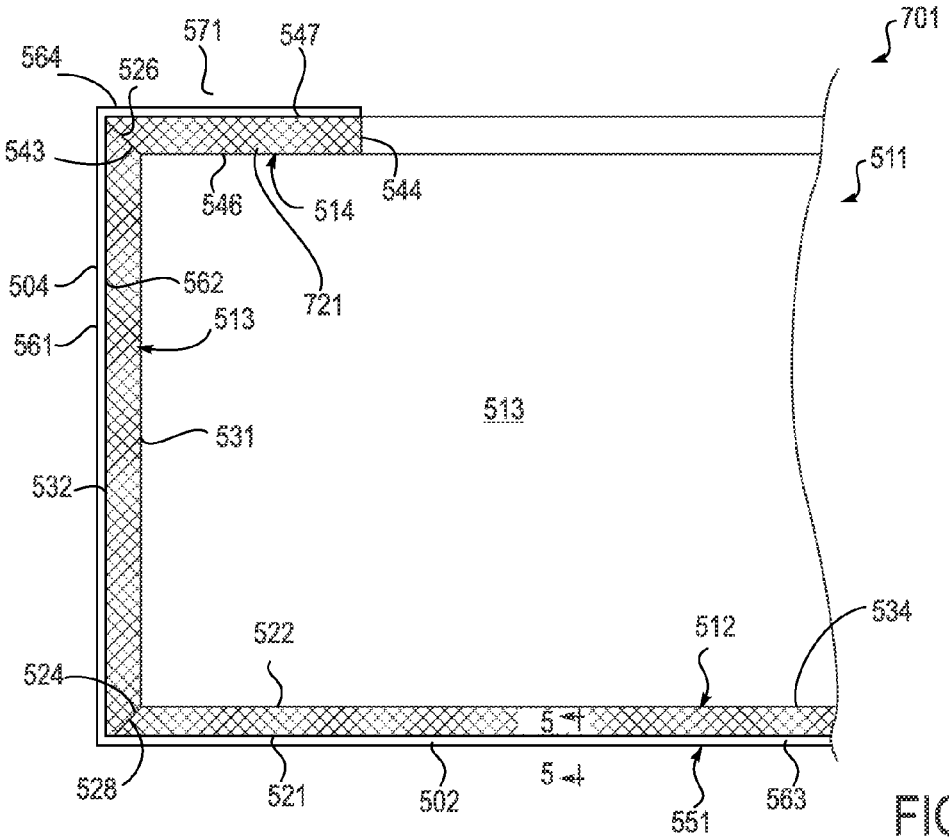
FIG. 11 is a cross-sectional view, similar to FIG. 4, of a portion of another embodiment of the image display of the present invention.
Figure 12:
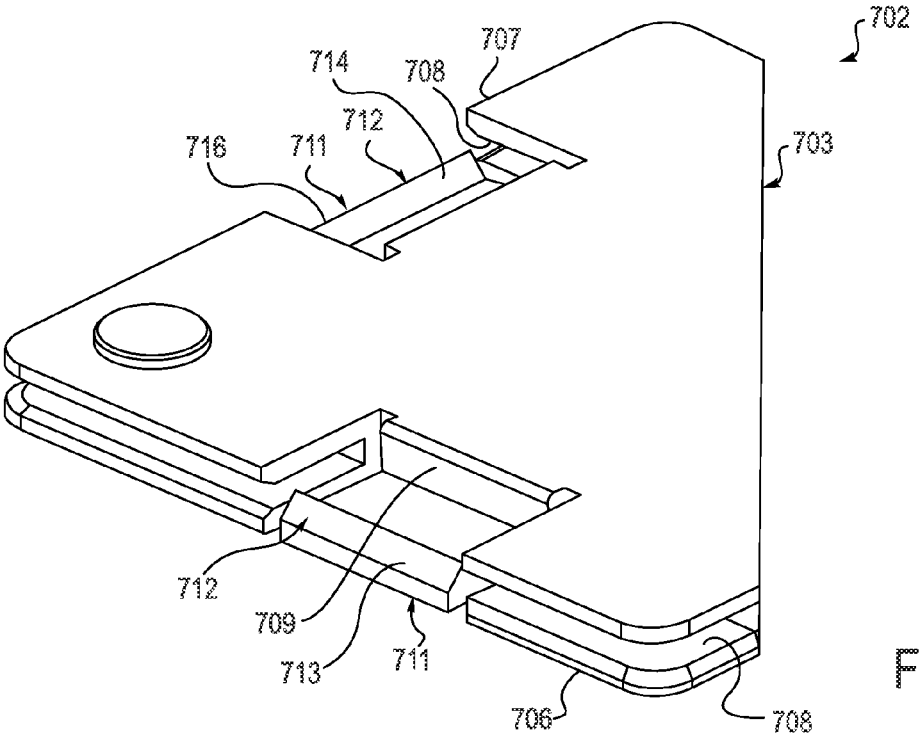
FIG. 12 is an isometric view of a corner clip for use with the image display of FIG. 11.

Another embodiment of an image display of the present invention is illustrated in FIGS. 9-10. Image display 601 illustrated therein can be of any suitable size and shape and material, for example as discussed above, and in one embodiment is substantially similar to image display 501. Like reference numerals have been used to describe like components, elements and features of image displays 601 and 501. Images display 601 includes a support structure 602 formed from a front or central sheet 603, a plurality of peripheral or side strips 604 and a plurality of optional backs strips 606. An optional back sheet 607 can be included in the support structure 602. Support structure 602 can be substantially rigid, but each of the central sheet 603, side strips 604, back strips 606 and back sheet 607 can be made from a substantially lightweight and not substantially rigid material such as paperboard, cardboard or plastic. In one embodiment, such elements of the support structure 602 are each made from paperboard or another suitable material of similar weight and rigidity. The paperboard or other material of the support structure 602 can be of any suitable thickness, in one embodiment has a thickness of not more than 0.060 inch. In one embodiment, such paperboard or other material has a thickness of not more than 0.030 inch. In one embodiment, such paperboard or other material has a thickness of not more than 0.014 inch.

Central sheet 603 can have a size and shape similar to central sheet 512 and can have a front surface 521, a rear surface 522 and a periphery 523 formed from a plurality of four edges 524. Side strips 604 can have a size and shape similar to side strips 513 and can have opposite ends 526 and 527, opposite side edges 528 and 529, an inner surface 531 and an outer surface 532. Back strips 606 can have a size and shape similar to back strips 514 and can have opposite ends 541 and 542, opposite edges 543 and 544, an inner surface 546 and an outer surface 547. First and second ends 541 and 542 can be mitered as discussed above.

The central sheet 603, side strips 604 and back strips 606 can be formed from a single sheet of paperboard, or similar material as discussed above, for example having a shape such as the shape of the central sheet 512, side strips 513 and back strips 514 shown in FIG. 1. Instead of beveled edges, as discussed above for sheet 512, side strips 513 and back strips 514, the adjoining edges 524 of sheet 603 and edges 528 of strips 604 can be formed from a score or similar indentation or weakening in the sheet of material so as to facilitate folding of the material at such edges. Similarly, a score or similar indentation or weakening in the sheet of material can be formed at the adjoining edges 529 of strips 604 and edges 543 of back strips 606 to facilitate folding of the material at such edges. Ends 526 and 527 of the side strips 604 need not be beveled. The support structure 602 can be formed by folding the sheet of paperboard or similar material, for example as shown in FIG. 4 and described above with respect thereto and support structure 511, to form the box-like support structure 602 having an internal cavity 534.

An optional internal support 611 can be included in internal cavity 534 of the support structure 602 for enhancing the rigidity of the front sheet 603 of the support structure 602. Although any suitable internal means or structure can be provided for enhancing the rigidity of the front sheet 603, for example similar to internal supports 572 and 591 discussed above, in one embodiment the internal support 611 is a suitable foam that fills all or part of the internal cavity 534. The foam of support 611 can be of any suitable type and in general can be the lowest cost foam that together with the support structure 602 provides a rigid structure for supporting the image substrate 551 and thus provides the image substrate 551 as having the appearance of being stretched across a conventional stretcher bar frame. The foam of internal support 611 can be any of the foams discussed above with respect to internal support 591.

In one embodiment, foam internal support 611 has a size and shape resembling the size and shape of internal cavity 534 of the support structure 602. In the illustrated embodiment, internal support 611 has substantially the shape of a parallelepiped with a first or top planar surface 612 that engages rear 522 of central sheet 603, a second or bottom planar surface 613 that engages the rear or backside of back sheet 607 and the inner surface 546 of back strips 606, and four side surfaces 614 that each engage an inner surface 531 of the respective side strip 604. The top surface 612 can be secured to the rear 522 of the central sheet, the bottom surface 613 can be secured to the rear of back sheet 607 and the inner surface 531 of the back strips 606 and the side surfaces 614 can be secured to the inner surfaces 531 of the side strips 604 by any suitable means such as an adhesive or glue.

The foam internal support 611 can be solid, for example having no recesses or openings therein, or be an open structure, for example a latticework, so as to reduce the amount of foam and thus the cost of the image display 601. For example, the foam internal support 611 can be a latticework or grid structure formed from a plurality of first strips 596 and second strips 597 extending perpendicular to the first strips 596, as discussed and illustrated above with respect to internal support 591, and have a plurality of openings 598 or through holes extending between surfaces 593 and 594 which can, for example, be arranged in rows and columns.

Image display 601 can be used with any suitable image substrate, including image substrate 551 discussed in detail above. Like image display 501, the image display 601 has a clean appearance at each of its corner 553, and in this regard is free of visible flaps or other gathered portions of the image substrate 551. As discussed above with respect to image display 501, the image substrate 551 can be cut to a size which approximates the plan size and shape of the unfolded support structure 602. A flap 566, which can be triangular in shape, extends between the end folded ends 526 and 527 of each adjacent pair of side strips 604. Each flap 566 has an outer edge 567 that is collinear with angled edges 543 and 544 of the adjacent back strips 606.

As part of the folding step of the method, each flap 566 is folded inwardly, for example at a central or other crease 583 illustrated in FIG. 4 with respect to image display 501, so that the inwardly folded flap extends between the abutting ends 526 and 527 of adjoining side strips 604 and between abutting ends 541 and 542 of adjoining optional back strips 606 when the support structure 602 and image display 601 are fully formed. Such inward folding of the corners of image substrate 551 into support structure 602 advantageously provides the image display with corners 533, side surfaces 504 and a rear surface 503 that is clean in appearance and free of visible folds in the image substrate 551. In this manner, the appearance of the image substrate is enhanced.

In one embodiment, the internal support 611 is placed on central sheet 603 before the folding together of the paperboard or other material of the support structure 602. A slit 616 can be provided at each corner of the internal support 611 for receiving the inwardly-folding flaps 566 of the image substrate 551. Each slit 616, one of which is shown schematically in FIG. 9, can between surfaces 612 and 613 of the support 611 and extend diagonally towards the center of the support 611. The back sheet 607 can be secured to the bottom surface 613 of the internal support 611 and to the back strips 606 after the folding of the support structure 602 has been complete.

The engagement and adherence of the internal support 601 with the central sheet 603, the back sheet 607, the side strips 604 and the back strips 607 provides rigidity to the support structure 602, and permits each of such elements or components of the support structure 602 to be made from a relatively non-rigid material, and thus less costly material, such as paperboard. The rigidity of support structure 602 can be similar to the rigidity of a conventional stretcher bar frame, and thus permit the image substrate 551 mounted on the support structure 602 to resemble, in appearance and robustness, an image substrate mounted on a conventional stretcher bar frame.

Figure 13:
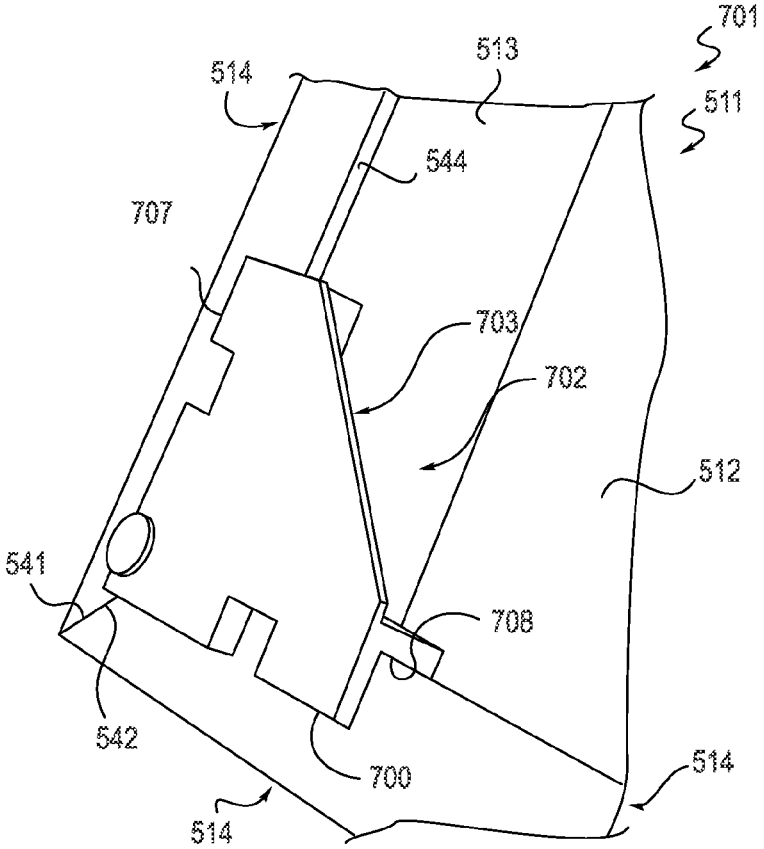
FIG. 13 is an enlarged view of a portion of the image display of FIG. 11 utilizing the corner clip of FIG. 12.
Figure 14:
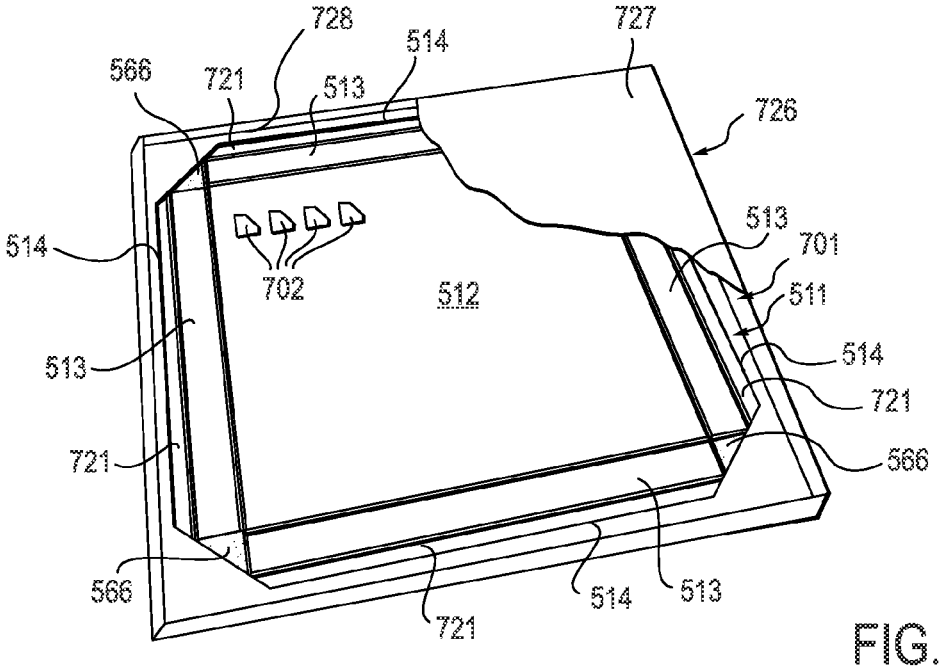
FIG. 14 is an isometric view of a kit, a portion of the container of which is cut away, for shipping the disassembled image display of FIG. 11 and the corner clips of FIG. 12.

Other embodiments of the image display of the present invention can be provided, for example as illustrated in FIGS. 11-14. Image display 701 therein is substantially identical to image display 501 and like reference numerals have been used to describe like components of image displays 701 and 501 (See FIG. 11). In one embodiment, image display 701 does not include back sheet 516 and in one embodiment the display 701 does not include corner flaps 566. The image display illustrated in FIGS. 11-14 includes corner flaps 566. Image display is particularly suitable for being shipped to a consumer or user in a disassembled condition, for example flat as illustrated in FIG. 14, and easily assembled by the consumer upon receipt and prior to use.

A mechanism or assembly 702 is included in image display 701 for easily coupling or securing together the peripheral strips, which can include side strips 513 and optional back strips 514, at the point of use by the consumer or user of the image display. The mechanism or assembly 702 can secure together the peripheral strips and by doing so bring the peripheral strips together so as to extend end-to-end to each other around the periphery of the central sheet 512 and the assembled support structure 511. Where image display 701 includes optional back strips 514, the mechanism or assembly 702 can secure together back strips 514 and by doing so bring the side strips 513 together so as to extend end-to-end to each other around the periphery of the central sheet 512 and the assembled support structure 511. Although such mechanism or assembly 702 can include adhesives, in one embodiment such mechanism or assembly need not include adhesives. In one embodiment, mechanism or assembly 702 can be any suitable mechanical clip or device for securing the support structure in its assembled state or condition, and in one embodiment the mechanism or assembly can be any suitable corner clip or device for securing together the corners of the support structure 511 so as to retain the front sheet 512, side strips 513 and optional back strips 514 in an assembled condition or state.

In one embodiment, mechanism 702 is a corner clip for mechanically securing together the adjoining back strips 514 and more specifically for bringing together flush the respective ends 541 and 542 of adjoining back strips 514 (see FIG. 13). The corner clip 702 can be of any suitable type and in one embodiment is a formed from a body 703 made from any suitable material such as plastic (see FIG. 12). Body 703 has a first side 706 and a second side 707 extending at the same angle that the respective back strips 514 extend relative to each other in the assembled support structure 511. In one embodiment where the support structure has a rectangular shape when viewed in plan, first and second sides 706, 707 extend orthogonal to each other. Each of the sides 706, 707 is formed with a channel or slot 708 for receiving the respective back strip 514 and a base or end surface 709 against which the second edge 544 of the strip 514 seats. A flexible tab 711 is provided on each side 706, 707 and extends along one side of the slot 708. Each of the tabs has a protuberance or extension 712 extending from a side of the tab into the slot 708. In one embodiment, the protuberance is a side extension or ridge 712 that has a first side surface 713 that is inclined away from the respective side 706, 707 and a second side surface 714 that extends from the tab 711 to meet the first side surface 713 at an edge 716.

The side extension or ridge 712, which can be provided at the end of the tab 712, is sized and shaped to cooperatively engage a slot or groove 721 formed on first or inner surface 546 of the back strip 514 at least on each end portion of the strip. The ridge 712 is spaced from base surface 709 of the clip 702 so that the ridge seats within the groove 721 when the second edge 544 of the strip 514 is seated or flush against base surface 709 of the clip. The inclined first side surface 713 of the side extension 712 serves to ride against edge 544 when the end portion of the strip 514 is pressed into the slot 708, thus causing the tab 711 to flex outwardly during placement of the strip 514 within the slot 708 of the clip 702. The ridge 712 and groove 721 are cooperatively sized and shape to retain the strip 514 secured to the clip 702 when the ridge 712 is seated in the groove 721. In one embodiment, the groove 721 has a cross-sectional shape that corresponds with the cross-sectional shape of the ridge 712, both illustrated as being triangular in FIGS. 11-12. In the foregoing manner, the ridge 712 and tab 711 can serve as a locking element provided in each side 706, 706 of the slip for cooperation with the respective back strip 514 of the support structure 511.

The disassembled image display 701, having an image formed thereon in any suitable manner such as discussed herein, can be shipped to the consumer or user with the support structure 551 in a disassembled or flat condition, as illustrated in FIG. 14. In one embodiment, the image is formed on image substrate 551, which is adhered to the support structure 551 either before or after the image is formed thereon. A kit 726 suitable for such shipment can include a suitable container 727 made from any suitable material such as cardboard or another paper product or other material. In one embodiment, the container 727 is a low profile box having a size and shape that closely resembles the size and shape of the disassembled support structure 511. Container 727 includes an internal cavity 728 for receiving the contents of the kit 726, including the central sheet 512 and the peripheral strips in a planar or unfolded condition or state and in one embodiment made from fiberboard. In one embodiment, the peripheral strips include side strips 513 and back strips 514, secured together and to central sheet 512 in the manner discussed above. In addition to the disassembled support structure, a suitable plurality of securement mechanisms 702 are included in the cavity or inside 728 of the container, for example a plurality of at least four corner clips 702 are included where the assembled support structure 511 has a rectangular shape when viewed in plan and has four side strips 513 and four back strips 514. One embodiment of a kit 726 is illustrated in FIG. 14, where a portion of container 727 is cut away to reveal internal cavity 728 and the contents of the kit disposed in the cavity 728.

In operation and use, the image is formed on the support structure 551 in any suitable manner, including any of the manners discussed herein. The disassembled support structure 551 is placed in the container 727 along with a suitable plurality of securement mechanisms 702 and shipped to the consumer or user. Upon receipt, the user folds the side strips 513 and optional back strips 514 backwardly relative to the central sheet 512 until the side strips 513 abut or engage each other end-to-end orthogonal to the central sheet 512 and the back strips 514 abut or engage each other end-to-end orthogonal to the side strips 513 and parallel to the central sheet 512. The securement mechanisms 702, in one embodiment being the corner clips 702, are secured to the respective end portions of adjoining back strips 514 in the manner discussed so as to rigidly retain the support structure 551 in its assembled state, a portion of which is illustrated in FIG. 13.

Kit 726 advantageously permits the support structure 551 to be shipped disassembled in a smaller container than when assembled, and thus at a lesser cost than when assembled. Securement mechanisms 702 permit the user to easily and quickly assemble the support structure 551 and thus image display 701 without the use of adhesives, although it is appreciated that adhesives could be used with securement mechanisms 702 in one embodiment of the invention. The preformed grooves 581 and 582 formed in the fiberboard or other sheet of the support structure facilitate folding of such sheet at the desired location so as to form the desired side strips 513 and optional back strips 514.

Other kits can be provided and be within the scope of the invention. For example, a kit (not shown) substantially similar to kit 726 can be provided. Container 727 thereof includes internal cavity 728 for receiving the contents of the kit, including the central sheet 512 and the peripheral strips in a planar or unfolded condition or state and made from fiberboard. In addition to the disassembled support structure, back sheet 516 can be included in such kit instead of the plurality of securement mechanisms 702 and in one embodiment the back sheet is made from paperboard, for example chipboard. A container of a suitable adhesive (not shown) can be included in such kit for adhering the back sheet 516 to the back strips 514 in the manner discussed above such that the back strip 514 is the sole means for securing the central sheet 512, side strips 513 and back strips 514 together.

Any other suitable image substrate can be used with the support structures of the present invention, including the support structures described herein. In one embodiment, for example, the image substrate can be any flexible material that can be laminated to a support structure of the invention. For example, suitable image substrates include conventional photo paper. A suitable image substrate can include any metalized paper or plastic film that can be printed on, or any metal or material that looks like metal that can be printed on. For example, a suitable such image substrate can include an aluminum outer surface that can be printed on. A suitable plastic film can be a film made from polyester. In one embodiment, a suitable image substrate can be paper or another material that has a wood-textured appearance. Similarly, the image substrates of the present invention can be used with any suitable support structure, including a conventional stretcher bar frame, any support structure resembling a stretcher bar frame or any other support structure.

The support structures with image substrates mounted thereon of the invention can be used for other than image displays. For example, an image substrate having a face of a clock printed thereon can be mounted to a support structure and clock mechanics provided inside the support structure to provide a clock. It is appreciated that the invention includes any apparatus having a support structure and an image substrate laminated thereon, including an image substrate of the invention, and electrical mechanisms, mechanical mechanisms, electro-mechanical mechanism or any other mechanism provided in the support structure.

While the image display has been described with reference to certain embodiments herein, modifications or changes to the embodiments described may be made and still be within the scope of the invention. For example, the base of the support structure of the invention may be a block, a ball, or some other three-dimensional shape, where the mounting surface is just one surface thereof. That is, the base is not limited to a planar structure. In another embodiment, the support structure may include a curved surface or jagged surface for displaying the image. Where a jagged surface is provided, edges, corners, or other discontinuities in the surface may correspond to features of the image being displayed.

In another example, where the edge of the support structure or image substrate is continuous, that is for example a round or oval periphery, folding of the edge may be difficult due to an arcuate shaped edge. In these cases, the edge of the support structure or image substrate may include intermittent slits which may reduce the length of the arc to be folded thereby reducing any warping of the edge due to folding. As such, the edge modifications described may include such slits.

In still other embodiments, the image substrate, either as part of the support structure or separate therefrom, may alternatively be a board-like material in the form of plastic, rubber, cardboard, fiberboard, wood, or metal. Other board-like materials can also be used.

In other embodiments of the invention, the image substrates can be used in other industries, such as the home decor industry. For example, the image substrate can be a wallpaper or other decorative material. The embossed or textured pattern can be any suitable design or configuration.

The image displays described herein are inexpensive alternatives to currently-available image displays, particularly currently-available image displays utilizing stretcher bar frames. Embodiments of the innovative and economical support structures of the image displays herein can have the appearance of canvas stretched over a stretcher bar frame or other more expensive support structure. The support structures of the image displays herein use less expensive materials, utilize unique configurations of support elements and are formed in processes capable of automation, thus providing a more economical yet professional looking image display. The image displays herein can simulate a stretched and taut canvas or other image substrate, thus being capable of providing a planar image. Additionally, the image displays herein can be easily scaled to accommodate both small and large images.

The image substrates herein can have the appearance of an artist's canvas, and may or may not include a woven textile or other substrate layer. Where a woven or other textile or fabric layer is utilized, such substrate layer can be relatively lightweight so as to be relatively inexpensive. Where a paper layer is utilized in place of a textile or fabric layer, further cost reductions can be provided.

The image substrates herein, and as illustrated on the support structures herein, can extend across greater or lesser portions of the support structures than as described or illustrated herein. For example, the image substrates need not extend to the rear of the support structures, need not extend to the sides of the support structures and need not extend all of the front of the support structure. The image formed on the outer surface of the image substrates herein can extend across all or any portion of such outer surface, regardless of the position of the image substrate on the respective support structure.

Each of the image substrates herein can be used with each of the support structures herein or any other support structure, including any conventional support structure such as a conventional stretcher bar frame and any support structure having the appearance of a stretcher bar frame. Each of the support structures herein can be used with any image substrate, including any conventional image substrate and any image substrate resembling artist canvas.

As used herein, the terms "front," "back," and/or other terms indicative of direction are used herein for convenience and to depict relational positions and/or directions between the parts of the embodiments. It will be appreciated that certain embodiments, or portions thereof, can also be oriented in other positions.

In addition, the term "about" should generally be understood to refer to both the corresponding number and a range of numbers. In addition, all numerical ranges herein should be understood to include each whole integer or fraction thereof within the range. While an illustrative embodiment of the invention has been disclosed herein, it will be appreciated that numerous modifications and other embodiments can be devised by those skilled in the art. Therefore, it will be understood that the appended claims are intended to cover all such modifications and embodiments that come within the spirit and scope of the present invention.

In one embodiment, an image display is provided that can include a substantially rigid support structure having a rectangular central sheet, four side strips and four back strips, an image substrate on at least the front of the central sheet and having an image thereon, the central sheet having a front and a rear and four edges at its periphery, the side strips extending alongside respective edges of the central sheet at a right angle to the central sheet and having respective opposite ends and being adjoined to form four corners and the back strips extending along respective side strips at a right angle to the side strips and having respective opposite ends and being adjoined at respective corners for forming the assembled support structure, and a mechanical securement device connected to adjoined back strips at each corner for rigidly securing the adjoined back strips together and for retaining the side and back strips in assembled position relative to the central sheet.

The image substrate can have opposite first and second surfaces and a central and peripheral portions, the image printed on the first surface, the second surface of the image substrate adhered to the front of the central sheet so that the central sheet forms a rigid backing for the central portion of the image substrate and the peripheral portions of the image substrate adhered to the side strips and back strips. Each mechanical securement device can be a plastic corner clip. Each corner clip can have first and second sides extending orthogonal to each other, each of the first and second sides having a slot for receiving the respective back strip. Each of the back strips can have a groove and each of the corner clips can have a flexible tab having a locking element for seating within the groove for locking the corner clip to the back strip.

In one embodiment, an image display kit is provided that can include a container having an internal cavity, a substantially rigid sheet having opposite first and second surfaces and a central portion having a periphery, a plurality of a peripheral strips extending around the periphery of the sheet and having respective opposite ends, an image substrate on at least a portion of the first surface of the central portion and having an image thereon, the sheet being provided with a plurality of grooves in the second surface between the central portion and the peripheral strips for facilitating folding of the peripheral strips relative to the central portion, the sheet being carried in the internal cavity of the container in an unfolded condition, and a plurality of mechanical securement devices carried in the internal cavity of the container for securing together adjacent respective peripheral strips during assembly of the image display.

The image substrate can have opposite first and second surfaces and a central and peripheral portions, an image printed on the first surface, the second surface of the image substrate adhered to the front of the central sheet so that the central sheet forms a rigid backing for the central portion of the image substrate and the peripheral portions of the image substrate adhered to the side strips and back strips. Each mechanical securement device can be a plastic corner clip. The plurality of peripheral strips can include a plurality of side strips and a plurality of back strips, the plurality of side strips extending around the central portion and having respective opposite ends and the plurality of back strips extending around the side strips and having respective opposite ends, the sheet being provided with a plurality of first grooves in the second surface between the central portion and the side strips for facilitating folding of the side strips relative to the central portion and the sheet being provided with a plurality of second grooves in the second surface between the side strips and the back strips for facilitating folding of the back strips relative to the side strips, the plurality of mechanical securement devices being carried in the internal cavity of the container for securing together adjacent respective back strips during assembly of the image display.

In one embodiment, an image display is provided that can include an image substrate consisting of a plastic layer, the plastic layer having an outer surface being embossed so as to be textured, an image printed on the outer surface, a substantially rigid support structure having a front and a plurality of side surfaces, the image substrate extending across the front and bending to the side surfaces and being secured to the support structure so as to have the appearance of being mounted to a stretcher bar frame.

The plastic layer can include a polymer layer and a print-receptive coating overlying the polymer layer. The outer surface can be embossed to have the appearance of artist canvas. The image substrate can be free of a base layer. The mage substrate can be free of a base layer selected from the group consisting of textiles, fabrics and knitted materials.

In one embodiment, an image substrate for use in displaying an image is provided that can include a substrate layer made from a textile having at least an open weave that is at least 25% open and at least one plastic layer overlying and adhered to the substrate layer, the at least one plastic layer having an outer surface for receiving a print of the image and being embossed so as to be textured.

The image substrate can be free of additional layers selected from the group consisting of textiles, fabrics and knitted materials. The outer surface can be embossed to have the appearance of artist canvas. The open weave can be approximately 50% open.

In one embodiment, a method for forming a printed image is provided that can include providing a molten layer of a plastic material, embossing the molten layer to have a texture, cooling the molten layer and digitally printing an image on the cooled layer of a plastic material.

The method can further include placing a print-receptive coating over the cooled layer before the printing step. The embossing and cooling steps can occur simultaneously. The texture can have the appearance of artist's canvas.

I claim:

1. An image display for resembling an image mounted on a wooden stretcher bar frame, comprising a substantially rigid support structure made of a rigid fiberboard and having a rectangular central sheet, four side strips and four back strips, an image substrate having an image thereon, the central sheet having a front and a rear and four edges at its periphery, the support structure being provided with a groove between the central sheet and each side strip so as to permit the side strips of the rigid fiberboard to extend alongside respective edges of the central sheet at a right angle to the central sheet, the side strips having respective opposite ends extending end-to-end to form four corners, the support structure being provided with a groove between each side strip and respective back strip so as to permit the back strips of the rigid fiberboard to extend along respective side strips at a right angle to the side strips, the back strips having respective opposite ends extending end-to-end at respective corners for forming the assembled support structure, and a mechanical securement device connected to the ends of respective back strips at each corner for rigidly securing the back strips together and for retaining the side and back strips in assembled position relative to the central sheet, the image substrate with the image thereon extending over the rigid central sheet and wrapped around the four rigid side strips thereby resembling an image mounted on a wooden stretcher bar frame.

2. The image display of claim 1, wherein the image substrate has opposite first and second surfaces and a central and peripheral portions, the image printed on the first surface, the second surface of the image substrate adhered to the front of the central sheet so that the central sheet forms a rigid backing for the central portion of the image substrate and the peripheral portions of the image substrate adhered to the side strips and back strips.

3. The image display of claim 1, wherein each mechanical securement device is a plastic corner clip.

4. The image display of claim 3, wherein each corner clip has first and second sides extending orthogonal to each other, each of the first and second sides having a slot for receiving the respective back strip.

5. The image display of claim 4, wherein each of the back strips has a groove and each of the corner clips has a flexible tab having a locking element for seating within the groove for locking the corner clip to the back strip.

6. A kit of an image display for resembling an image mounted on a wooden stretcher bar frame when assembled, comprising a container having an internal cavity, a nonfoldable rigid sheet having a central portion, a plurality of peripheral strips and a plurality of back strips, the sheet having opposite first and second surfaces and the central portion having a periphery, the peripheral strips extending around the periphery of the sheet and having respective opposite ends and the back strips extending alongside the peripheral strips, an image substrate on at least a portion of the first surface of the central portion and having an image thereon, the sheet being provided with a plurality of grooves in the second surface between the central portion and the peripheral strips for facilitating folding of the peripheral strips relative to the central portion and being provided with a plurality of grooves in the second surface between the peripheral strips and the back strips for facilitating folding of the back strips relative to the peripheral strips, the sheet being carried in the internal cavity of the container in an unfolded condition, and a plurality of mechanical securement devices carried in the internal cavity of the container for securing together adjacent respective back strips during assembly of the image display, the image substrate with the image thereon extending over the rigid central sheet and wrapped around the plurality of rigid peripheral strips upon assembly thereby resembling an image mounted on a wooden stretcher bar frame.

7. The image display kit of claim 6, wherein the image substrate has opposite first and second surfaces and a central and peripheral portions, the image printed on the first surface, the second surface of the image substrate adhered to the first surface of the central portion of the sheet so that the central portion of the sheet forms a rigid backing for the central portion of the image substrate and the peripheral portions of the image substrate adhered to the peripheral strips and back strips.

8. The image display kit of claim 7, wherein each mechanical securement device is a plastic corner clip.

9. An image display, comprising a substantially rigid support structure having a rectangular central sheet, four side strips and four back strips, an image substrate on at least the front of the central sheet and having an image thereon, the central sheet having a front and a rear and four edges at its periphery, the side strips extending alongside respective edges of the central sheet at a right angle to the central sheet and having respective opposite ends and being adjoined to form four corners and the back strips extending along respective side strips at a right angle to the side strips and having respective opposite ends and being adjoined at respective corners for forming the assembled support structure, and a plastic corner clip connected to adjoined back strips at each corner for rigidly securing the adjoined back strips together and for retaining the side and back strips in assembled position relative to the central sheet, each corner clip having first and second sides extending orthogonal to each other and each of the first and second sides having a slot for receiving the respective back strip, each of the back strips having a groove and the corner clip having a flexible tab provided with a locking element for seating within the groove to lock the corner clip to the back strip.

10. The image display of claim 9, wherein the image substrate has opposite first and second surfaces and a central and peripheral portions, the image printed on the first surface, the second surface of the image substrate adhered to the front of the central sheet so that the central sheet forms a rigid backing for the central portion of the image substrate and the peripheral portions of the image substrate adhered to the side strips and back strips.

* * * * *